US005580705A

United States Patent [19]

Ueda et al.

[11] Patent Number: 5,580,705

[45] Date of Patent: Dec. 3, 1996

05580689

[54] METHOD OF BLEACHING SILVER HALIDE COLOR PHOTOGRAPHIC LIGHT-SENSITIVE MATERIALS USING PARTICULAR FERRIC CHELATES

[75] Inventors: Yutaka Ueda; Satoru Kuse, both of Hino, Japan

[73] Assignee: Konica Corporation, Tokyo, Japan

[21] Appl. No.: 313,537

[22] Filed: Sep. 27, 1994

Related U.S. Application Data

[63] Continuation of Ser. No. 994,129, Dec. 21, 1992, abandoned.

[30] Foreign Application Priority Data

| | | | |
|---|---|---|---|
| Dec. 27, 1991 | [JP] | Japan | 3-358335 |
| Jan. 17, 1992 | [JP] | Japan | 4-006625 |
| Feb. 14, 1992 | [JP] | Japan | 4-028183 |

[51] Int. Cl.$^6$ ..... G03C 7/00; G03C 5/38; G03C 5/44; G03C 5/42

[52] U.S. Cl. ..... 430/400; 430/398; 430/430; 430/461

[58] Field of Search ..... 430/393, 400, 430/430, 461

[56] References Cited

U.S. PATENT DOCUMENTS

| | | | |
|---|---|---|---|
| 2,322,027 | 12/1940 | Jelley et al. . | |
| 2,533,514 | 11/1947 | Sawdey et al. . | |
| 2,767,172 | 10/1956 | Katz et al. . | |
| 2,767,173 | 10/1956 | Katz . | |
| 2,767,174 | 10/1956 | Katz et al. . | |
| 2,870,015 | 1/1959 | Allen et al. . | |
| 3,370,952 | 2/1968 | Dawson . | |
| 3,490,911 | 1/1970 | Burness et al. . | |
| 3,689,271 | 9/1972 | Nittel et al. . | |
| 3,725,067 | 4/1973 | Bailey et al. . | |
| 3,764,336 | 10/1973 | Nittel et al. . | |
| 3,765,897 | 10/1973 | Nittel . | |
| 4,014,764 | 3/1977 | Seiler et al. . | |
| 4,036,715 | 7/1977 | Baden et al. . | |
| 4,065,313 | 12/1977 | Shippey . | |
| 4,080,211 | 3/1978 | Van Paesschen et al. . | |
| 4,804,618 | 2/1989 | Ueda et al. | 430/461 |
| 5,149,618 | 9/1992 | Tappe et al. | 430/430 |
| 5,232,822 | 8/1993 | Ishikawa et al. | 430/393 |
| 5,234,801 | 8/1993 | Ishikawa | 430/393 |
| 5,238,791 | 8/1993 | Tappe et al. | 430/393 |
| 5,342,740 | 8/1994 | Goto et al. | 430/400 |
| 5,352,567 | 10/1994 | Okada et al. | 430/393 |

FOREIGN PATENT DOCUMENTS

| | | | |
|---|---|---|---|
| 0329088 | 8/1989 | European Pat. Off. | 430/430 |
| 0369999 | 11/1990 | European Pat. Off. . | |
| 0430000 | 6/1991 | European Pat. Off. . | |
| 0450293 | 10/1991 | European Pat. Off. | 430/430 |
| 0532003 | 3/1993 | European Pat. Off. . | |

OTHER PUBLICATIONS

Kostromina et al., "Stimulation of Seed, Sugar and Nectar Production of Lucerne by Fertilizing with Ferric–Chelated Ethylenediaminedisuccinic acid".

Aqueous Paste "*As Ukr. Gen. Inorg. Chem,*" Derwent abstract #84–145630.

Ueno, "Chelate Chemistry", vol. 5, Sect. 1, pp. 309, 311, 324 (translation).

"New Complexanes, VIII. Ethylenediamine–N, N'–disuccinic acid and investigation of its heavy metal complexes by spectrophotometry". J. Major et al.

Chem. Zvesti 20 (6), pp. 414–422 (*Chem. Abs.,* vol. 65, 1966, abstract No. 11737f).

"Stereospectric Ligands and their Complexes I. A Cobalt (III) Complex of Ethylenediamine disuccinic Acid", J. Neal et al. *Inorg. Chem.,* Nov. 1968, p. 2405.

*Primary Examiner*—Charles L. Bowers, Jr.
*Assistant Examiner*—J. Pasterczyk
*Attorney, Agent, or Firm*—Frishauf, Holtz, Goodman, Langer & Chick, P.C.

[57] ABSTRACT

A method for processing silver halide color photographic light-sensitive materials is disclosed. The process comprises regeneration of a bleaching-capable processing solution by addition of a regenerant, and use of a bleaching agent, which is a ferric complex salt of a compound of the following formula in the processing solution that has bleaching capability;

or

15 Claims, No Drawings

METHOD OF BLEACHING SILVER HALIDE COLOR PHOTOGRAPHIC LIGHT-SENSITIVE MATERIALS USING PARTICULAR FERRIC CHELATES

This application is a continuation of application Ser. No. 07/994,129, filed Dec. 21, 1992, now abandoned.

FIELD OF THE INVENTION

The present invention relates to a method for processing silver halide color photographic light-sensitive materials. More specifically, the present invention relates to a method for processing silver halide color photographic light-sensitive materials, which uses a processing solution high in biodegradability and is capable of minimizing the amount of waste liquids and providing images lower in bleach fogging.

BACKGROUND OF THE INVENTION

In general, silver halide color photographic light-sensitive materials are processed by use of a color developer, a bleach, a fixer, a bleach-fixer and a stabilizer. Among these processing solutions, the bleach and bleach-fixer contain a bleaching agent to bleach silver. For this purpose, ethylenediaminetetraacetate ferric complex salts are most widely used at present in processing color paper and color negative films. However, ethylenediaminetetracetate ferric complex salts are poor in biodegradability. If accidently discharged into a river or soil, they are accumulated there for a long time without undergoing degradation and, thereby, pollute the natural environment. Recently, 1,3-propanediaminetetracetate ferric complex salts (PDTA-Fe) described, for example, in Japanese Pat. O.P.I. Pub. Nos. 103041/1990, 103040/1990, 250651/1988 have been used. Although PDTA-Fe has high bleaching power and excellent rapid-processing capability, it causes bleach fogs when bleaching is carried out immediately after color developing. To eliminate the problem, the pH can be lowered by use of acetic acid or the like, but it causes other problems such as offensive smell and higher biochemical oxygen demand.

Another disadvantage of PDTA-Fe is its strong oxidizing power; therefore, thiosulfates used as fixing agent are decomposed into sulfur or sulfides when bleaching with PDTA-Fe is followed by processing with a fixer, or when PDTA-Fe is used as bleaching agent in a bleach-fixer.

Though diethylenetriaminepentaacetate ferric complex salts described, for example, in Japanese Pat. O.P.I. Pub. Nos. 118752/1986, 50145/1986, 50150/1986, 50147/1986 are known as a third bleaching agent, they also have shortcomings.

That is, these are not only poor in biodegradability but also are liable to cause yellow stains on edges of a light-sensitive material when used in processing color paper, particularly in processing carried out at a low replenishing rate.

Bleaching agents described, for example, in EPO, 430, 000A1 and German Pat. No. 3,939,756 are known as compounds having high biodegradability, but these bleaching agents are apt to lower the desilverizing property when employed in processing at a low replenishing rate and, as a result, deteriorate the rapid processing capability.

Methods for regenerating a bleach-fixer are described, for example, in Japanese Pat. O.P.I. Pub. Nos. 48245/1991 and 121451/1991. These methods, however, are used for regenerating bleach-fixers by means of a ferric complex salt of an aminopolycarboxylic acid such as ethylenediaminetetraacetic acid, diethylenetriaminepentaacetic acid, cyclohexanediaminetetraacetic acid or 1,3-diaminopropanetetraacetic acid. These compounds have a disadvantage of poor biodegradability or a tendency to decompose a fixing agent as described above. Therefore, these methods give neither suggestion as to the compound of the invention nor hint as to the effect of the invention described below.

SUMMARY OF THE INVENTION

Accordingly, a first object of the invention is to provide a method for processing a silver halide color photographic light-sensitive material, which uses a bleach or bleach-fixer excellent in biodegradability and environmental compatibility; a second object of the invention is to provide a method for processing a silver halide color photographic light-sensitive material, which can minimize the amount of waste liquids, reduce running cost and improve environmental compatibility; a third object of the invention is to provide a method for processing a silver halide color photographic light-sensitive material, which causes fewer yellow stains on edges of a light-sensitive material and less bleach fogging; and a fourth object of the invention is to provide a method for processing a silver halide color photographic light-sensitive material, which can provide a stable photographic processing capability over a long period.

The above objects of the invention are attained by a method for processing a light-sensitive material which comprises, after color development, processing of a light-sensitive material with a processing solution having a bleaching capability, wherein a used processing solution having a bleaching capability is regenerated by addition of a regenerant, and the bleaching agent contained in the processing solution having a bleaching capability is a ferric complex salt of a compound represented by the following formula [A-I], [A-II] or [A-III]:

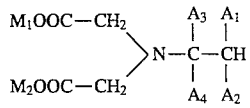

Formula [A-I]

In the formula, $A_1$, $A_2$, $A_3$ and $A_4$, which may be the same or different, each represent a hydrogen atom, an hydroxyl, —COOM, —$PO_3(M)_2$, —$CH_2COOM$, —$CH_2OH$ or lower alkyl group, provided that at least one of $A_1$, $A_2$, $A_3$ and $A_4$ is a —$CH_2COOM$, —COOM or —$PO_3(M)_2$ group; M, $M_1$ and $M_2$ each represent a hydrogen atom, an ammonium group, a sodium, potassium or lithium atom or an organic ammonium group.

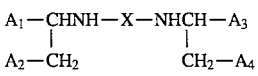

Formula [A-II]

In the formula, $A_1$, $A_2$, $A_3$ and $A_4$ each represent a —$CH_2OH$, —$PO_3(M)_2$ or —COOM group and may be the same or different; M represents a hydrogen atom or alkali metal atom or an ammonium or organic ammonium group; X represents an alkylene group having 2 to 6 carbon atoms or a —$(B_1O)_n$—$B_2$— group, where n represents an integer of 1 to 8, $B_1$ and $B_2$, which may be the same or different, each represent an alkylene group having 1 to 5 carbon atoms.

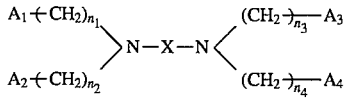

Formula [A-III]

In the formula, $A_1$, $A_2$, $A_3$ and $A_4$ each represent a $—CH_2OH$, $—PO_3(M_2)_2$ or $—COOM_1$ group and may be the same or different, where $M_1$ and $M_2$ each represent a hydrogen atom or alkali metal atom or an ammonium or organic ammonium group; X represents a straight-chain or branched alkylene group having 2 to 6 carbon atoms, a saturated or unsaturated ring-forming organic group or a $—(B_1O)n—B_2—$ group, where n is an integer of 1 to 8, $B_1$ and $B_2$, which may be the same or different, each represent an alkylene group having 1 to 5 carbon atoms; $n_1$, $n_2$, $n_3$ and $n_4$ each represent an integer of 1 or more and may be the same or different, provided that at least one of them is 2 or more.

One preferable embodiment of the invention is the method for processing silver halide color photographic light-sensitive materials in which the processing solution having a bleaching capability is a bleach.

Another preferable embodiment of the invention is the method for processing silver halide color photographic light-sensitive materials in which the amount of ammonium ions contained in the processing solution having bleaching capability is not more than 50 mol % of the total cat ions contained therein.

DETAILED DESCRIPTION OF THE INVENTION

The invention is hereinafter described in detail.

In the invention, the processing solution having a bleaching capability means a bleach or a bleach-fixer.

In Formula [A-I], $A_1$, $A_2$, $A_3$ and $A_4$, which may be the same or different, each represent a hydrogen atom, a hydroxyl, —COOM, $—OP_3(M)_2$ or $—CH_2OH$ group, or a lower alkyl group such as a methyl, ethyl, isopropyl or n-propyl group, provided that at least one of $A_1$, $A_2$, $A_3$ and $A_4$ is a —COOM or $—PO_3(M)_2$ group. M, $M_1$ and $M_2$ each represent a hydrogen atom, an ammonium group, a sodium, potassium or lithium atom or an organic ammonium group such as a trimethyl ammonium or triethanol ammonium group.

Preferable examples of the compound represented by Formula [A-I] are shown below:

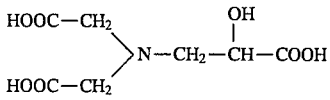

A-I-1

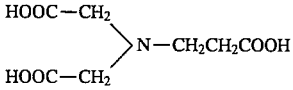

A-I-2

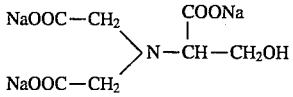

A-I-3

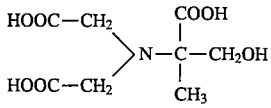

A-I-4

-continued

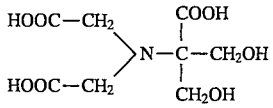

A-I-5

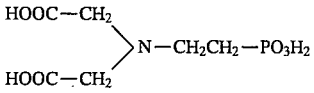

A-I-6

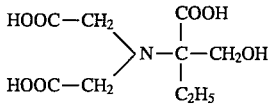

A-I-7

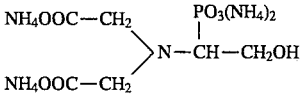

A-I-8

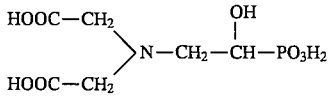

A-I-9

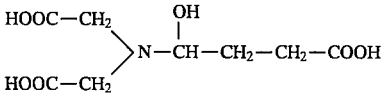

A-I-10

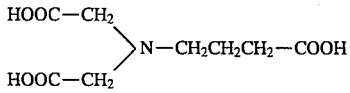

A-I-11

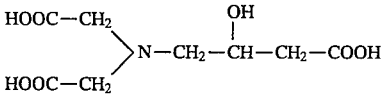

A-I-12

These compounds represented by Formula [A-I] can be synthesized according to the general synthetic methods described, for example, in Japanese Pat. O.P.I. Pub. Nos. 267750/1988, 267751/1988, 115172/1990, 295954/1990. Among these compounds, those denoted by (A-I-1) and (A-I-2) are particularly preferred.

The compound represented by Formula [A-II] is described hereunder.

In the formula, $A_1$ to $A_4$, which may be the same or different, each represent a $—CH_2OH$, $—PO_3(M)_2$ or —COOM group, where M is a hydrogen atom, an alkali metal atom such as sodium or potassium or another cation such as ammonium, methyl ammonium or trimethyl ammonium. X represents a substituted or unsubstituted alkylene group or a $—(B_1O)n—B_2—$ group each having 2 to 6 carbon atoms, where $B_1$ and $B_2$, which may be the same or different, each represent a substituted or unsubstituted alkylene group having 1 to 5 carbon atoms. Examples of the alkylene group represented by X include an ethylene group, trimethylene group and tetramethylene group. Examples of the alkylene group represented by $B_1$ and $B_2$ group include a methylene group, ethylene group and trimethylene group. Examples of the substituent of the alkylene group represented by X, $B_1$ or $B_2$ include a hydroxyl group and an alkyl group having 1 to 3 carbon atoms such as a methyl and ethyl group. n represents an integer of 1 to 8, preferably 1 to 4. Preferable examples of the compound represented by Formula [A-II] are shown below but the scope of the invention is not limited to them.

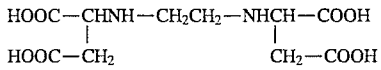
A-II-1

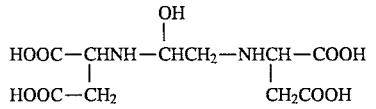
A-II-2

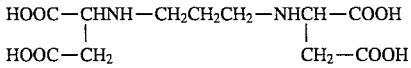
A-II-3

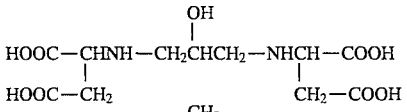
A-II-4

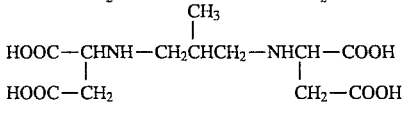
A-II-5

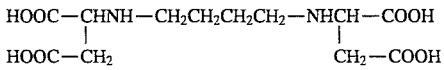
A-II-6

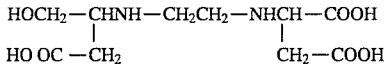
A-II-7

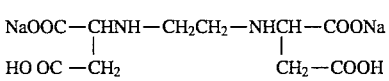
A-II-8

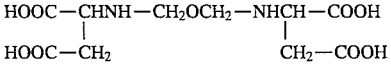
A-II-9

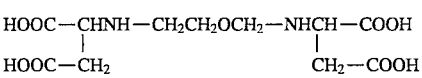
A-II-10

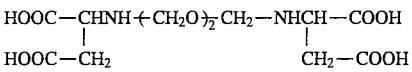
A-II-11

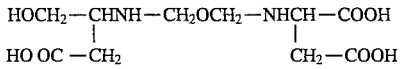
A-II-12

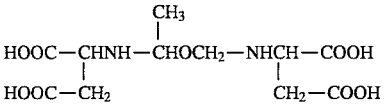
A-II-13

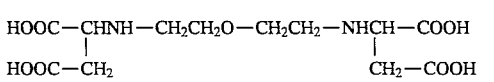
A-II-14

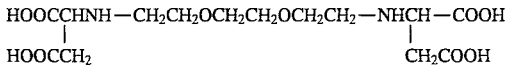
A-II-15

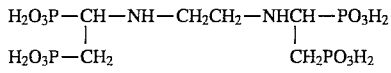
A-II-16

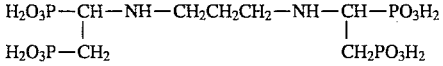
A-II-17

The compounds represented by Formula [A-II] can be synthesized according to a conventional method.

Among these compounds, those denoted by (A-II-1), (A-II-3) and (A-II-14) are particularly preferred.

The compounds represented by Formula [A-III] are described hereunder.

In the formula, $A_1$ to $A_4$, which may be the same or different, each represent a $—CH_2OH$, $—PO_3(M_2)_2$ or $—COOM_1$ group, where $M_1$ and $M_2$ each represent a hydrogen ion, an alkali metal ion such as a sodium or potassium ion, or another cation such as an ammonium, methyl ammonium or trimethyl ammonium ion.

X represents a straight-chain or branched alkylene group having 2 to 6 carbon atoms, a ring-forming saturated or unsaturated organic group or a $—(B_1O)_nB_2—$ group, where $B_1$ and $B_2$, which may be the same or different, each represents an alkylene group having 1 to 5 carbon atoms (including those having a substituent). $n_1$ to $n_4$, which may be the same or different, each represent an integer of 1 or more, provided that at least one of them is 2 or more. Examples of the alkylene group represented by X include an ethylene, trimethylene and tetramethylene group. Examples of the alkylene group represented by $B_1$ or $B_2$ include a methylene group, ethylene group and trimethylene group. Examples of the substituent of the alkylene group represented by X, $B_1$ or $B_2$ include a hydroxyl group and an alkyl group having 1 to 3 carbon atoms such as a methyl and ethyl group. n represents an integer of 1 to 8, preferable 1 to 4 and especially 1 to 2. The following are preferable examples of the compound represented by Formula [A-III], but preferable ones are not limited to them.

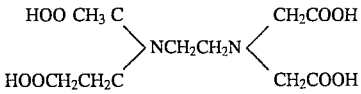
A-III-1

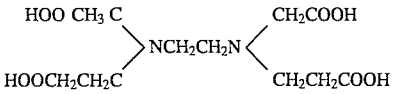
A-III-2

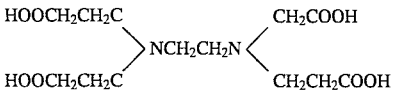
A-III-3

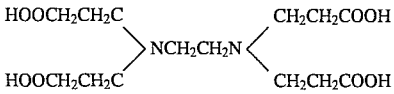
A-II-4

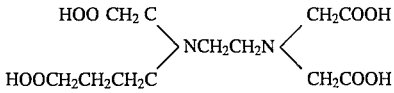
A-III-5

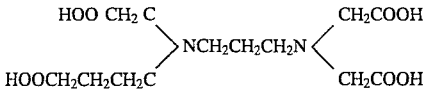
A-III-6

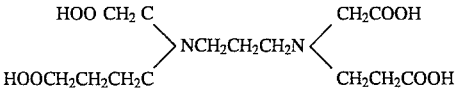
A-III-7

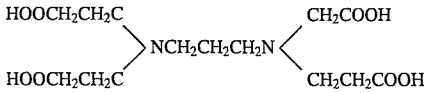
A-III-8

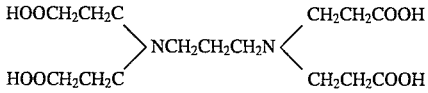
A-III-9

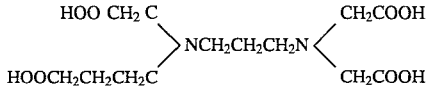
A-III-10

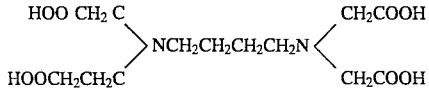
A-III-11

-continued

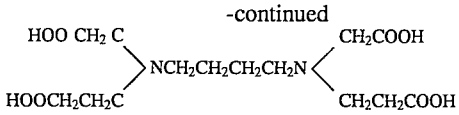
A-III-12

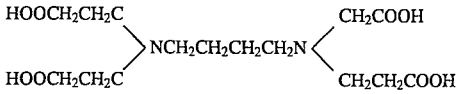
A-III-13

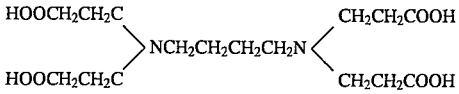
A-III-14

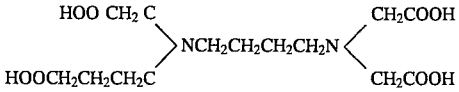
A-III-15

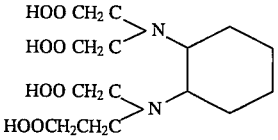
A-III-16

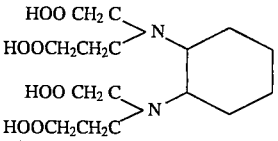
A-III-17

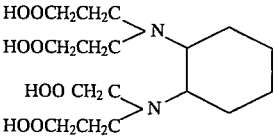
A-III-18

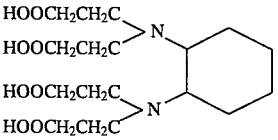
A-III-19

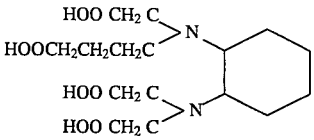
A-III-20

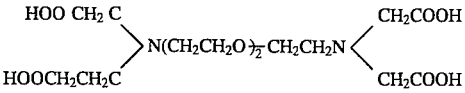
A-III-21

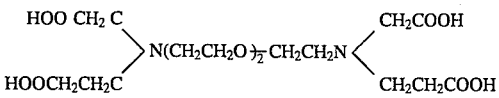
A-III-22

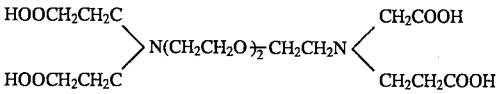
A-III-23

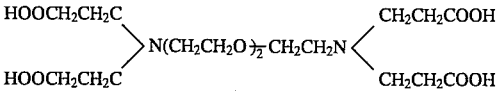
A-III-24

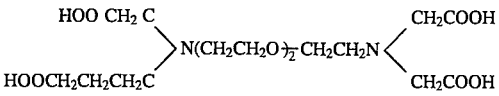
A-III-25

-continued

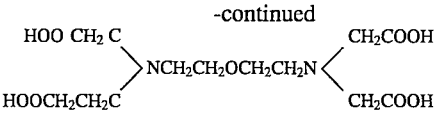
A-III-26

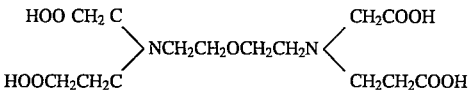
A-III-27

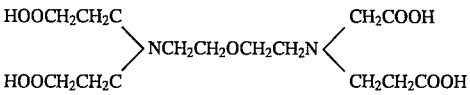
A-III-28

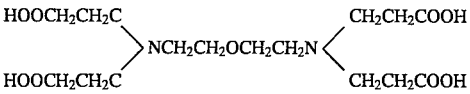
A-III-29

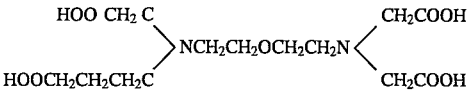
A-III-30

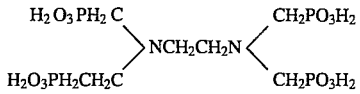
A-III-31

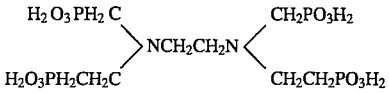
A-III-32

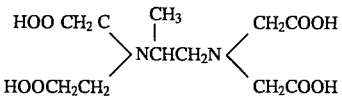
A-III-33

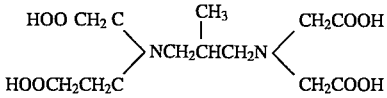
A-III-34

Among the above compounds, those denoted by (A-III-16), (A-III-17), (A-III-18), (A-III-19) and (A-III-20) contain both transforms and cis forms.

The compounds represented by Formula [A-III] can be synthesized by the usual method.

Among preferable examples, the compounds denoted by (A-III-1), (A-III-2) and (A-III-6) are particularly preferred.

The addition amount of a ferric complex salt of the compound represented by Formula [A-I], [A-II] or [A-III] is preferably within the range of 0.1 to 2.0 mole, especially within the range of 0.1 to 1.5 mole per liter of bleach or bleach-fixer.

In the invention, ferric complex salts of the following compounds can also be used as bleaching agents besides the ferric complex salts of the compound represented by Formula

[A-I], [A-II] or [A-III].

[A'-I] Ethylenediaminetetraacetic acid

[A'-2] Trans-1,2-cyclohexanediaminetetraacetic acid

[A'-3] Dihydroxyethylglycin

[A'-4] Ethlenediamine-tetrakismethylene-phosphonic acid

[A'-5] Nitrilotrismethylene-phosphonic acid

[A'-6] Diethylenetriamine-pentakismethylene-phosphonic acid

[A'-7] Diethylenetriaminepentaacetic acid

[A'-8] Ethylenediamine-di-ortho-hydroxyphenylacetic acid

[A'-9] Hydroxyethyl-ethylenediaminetriacetic acid

[A'-10] Ethylenediaminepropionic acid

[A'-11] Ethylenediaminediacetic acid
[A'-12] Hydroxyethyliminodiacetic acid
[A'-13] Nitrilotriacetic acid
[A'-14] Nitrilotripropionic acid
[A'-15] Triethylenetetraminehexacetic acid
[A'-16] Ethylenediaminetetrapropionic acid
[A'-17] 1,3-Propylenediaminetetraacetic acid
[A'-18] Glycol-ether-diaminetetraacetic acid In one preferable embodiment of the invention, exemplified compounds (I-1) to (VII-20) on pages 79–142 of the specification of Japanese Pat. Appl. No. 256383/1985 are added to the bleaching-capable processing solution of the invention. Among these compounds, particularly preferred ones are those denoted by (B-1) to (B-30) below.

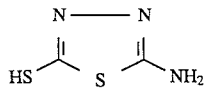
(B-1)

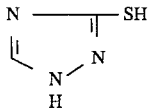
(B-2)

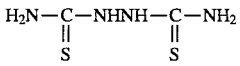
(B-3)

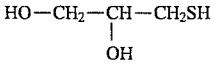
(B-4)

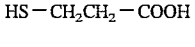
(B-5)

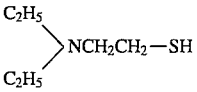
(B-6)

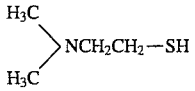
(B-7)

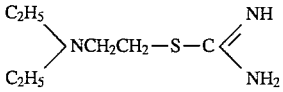
(B-8)

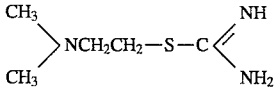
(B-9)

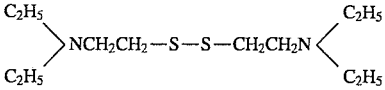
(B-10)

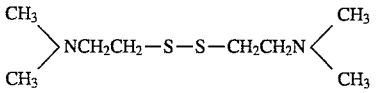
(B-11)

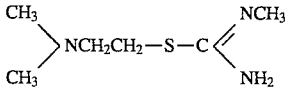
(B-12)

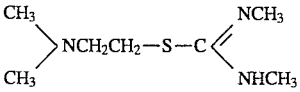
(B-13)

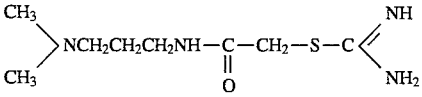
(B-14)

-continued

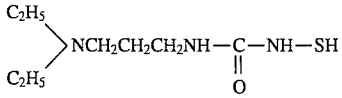
(B-15)

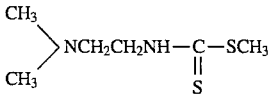
(B-16)

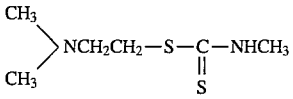
(B-17)

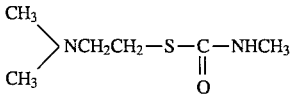
(B-18)

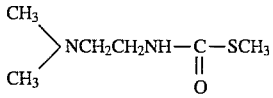
(B-19)

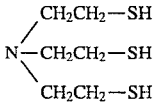
(B-20)

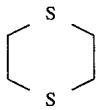
(B-21)

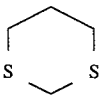
(B-22)

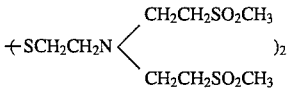
(B-23)

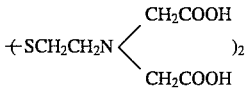
(B-24)

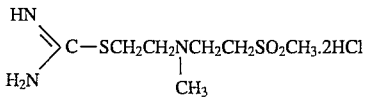
(B-25)

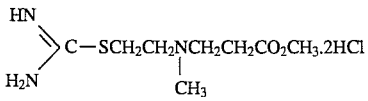
(B-26)

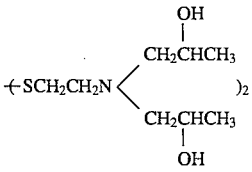
(B-27)

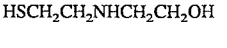
(B-28)

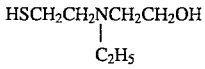
(B-29)

-continued

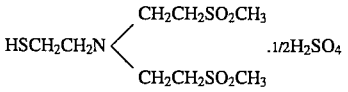

(B-30)

These compounds are used in an amount of preferably 0.05 to 50 g, especially 0.1 to 20 g per liter of processing solution.

Among these processing solutions having a bleaching capability, particularly preferred are a bleach using a ferric complex salt of the compound of Formula [A-I] and a bleach-fixer using a ferric complex salt of the compound of Formula [A-II].

These bleaches and bleach-fixers are used in a temperature range of 20° to 50° C., preferably 25° to 45° C.

The pH of the bleach is preferably not more than, especially 1.0 to 5.5. The pH of the bleach-fixer is preferably 5.0 to 9.0, especially 6.0 to 8.5. The pH of the bleach or the bleach-fixer described here is a pH of a processing bath in which a silver halide light-sensitive material is being processed, and it is clearly distinguished from the pH of a replenisher.

In addition to the above compounds, the bleach or the bleach-fixer may contain halides, such as ammonium bromide and sodium bromide, as well as a variety of optical whitening agents, defoamers and surfactants.

A preferred replenishing amount of the bleach or the bleach-fixer is not more than 1000 ml, preferably 20 to 600 ml and especially 40 to 500 ml per square meter of light-sensitive material. As the replenishing amount decreases, the effect of the invention becomes more conspicuous.

In the invention, air or oxygen may be blown into a processing bath and a replenisher storage tank, if desired, in order to raise the activity of the bleach or the bleach-fixer. Addition of a suitable oxidizing agent, such as hydrogen peroxide, bromates or persulfates, is also effective as an alternative measure.

As fixing agent used in the fixer or the bleach-fixer according to the invention, thiocyanates or thiosulfates are preferably used. The thiocyanate content is at least 0.1 mol/l and, in processing color negative films, it is preferably not less than 0.5 mol/l, especially not less than 1.0 mol/l. The content thiosulfate content is at least 0.2 mol/l and, in processing color negative films, it is preferably not less than 0.5 mol/l.

The objects of the invention are attained much more effectively by using jointly thiocyanates and thiosulfates.

Besides these fixing agents, the bleach or the bleach-fixer of the invention may contain one or more types of pH buffers comprising various salts. Further, it is preferred that rehalogenating agents, such as alkali halides and ammonium halides including potassium bromide, sodium bromide, sodium chloride and ammonium bromide, be contained therein in a large amount.

There may also be added alkylamines and polyethylene oxides which are usually known as additives for a fixer or a bleach-fixer.

Silver may be recovered from the bleach-fixer of the invention according to the usual method.

The processing time with the bleach and the fixer is not limited, but it is desirably not more than 3 min and 30 sec, more desirably within the range of 10 sec to 2 min and 20 sec, and most desirably within the range of 20 sec to 1 min and 20 sec. The processing time with the bleach-fixer is preferably not more than 4 min, especially within the range of 10 sec to 2 min and 20 sec.

In the embodiment of the invention, the effect of the invention can be brought out well when the content of ammonium ions in the bleach, or in the bleach-fixer and the regenerant described later, is not more than 50 mol % of the total amount of cations contained therein. Preferably, the amount is not more than 30 mol %; in a particularly preferred embodiment, it is not more than 10 mol %.

In order to bring out the effect of the invention adequately and to improve the rapid processing capability, it is preferable that the bleach or the bleach-fixer used in the invention be subjected to forced stirring. The term "forced stirring" used here does not mean ordinary self-stirring due to flow of a liquid, but it means to stir the processing solution forcedly by use of a stirring means. Usable stirring means include those described in Japanese Pat. O.P.I. Pub. Nos. 222259/1989 and 206343/1989.

As another effect of the invention, bleach fogging can be minimized by setting the crossover time from a color developing bath to a bleaching or bleach-fixing bath at not more than 10 seconds, preferably not more than 7 seconds.

In view of the effect of the invention, it is preferable not to use acetic acid in the bleach and the bleach-fixer of the invention.

Further, it is preferable that the bleach and the bleach-fixer of the invention contain a compound represented by the following formula [II]:

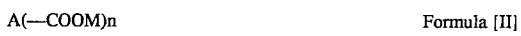

A(—COOM)n Formula [II]

In the formula, A is an n-valent organic group, n is an integer of 1 to 6 and M represents an ammonium, an alkali metal atom (sodium, potassium, lithium) or a hydrogen atom.

In Formula [II], the n-valent organic group represented by A includes an alkylene group (e.g., methylene, ethylene, trimethylene, tetramethylene), an alkenylene group (e.g., ethenylene), an alkynylene group (e.g., ethynylene), a cycloalkylene group (e.g., 1,4-cyclohexanediyl), an arylene group (e.g., o-phenylene, p-phenylene), an alkanetriyl group (e.g., 1,2,3-propanetriyl) and an arenetriyl group (e.g., 1,2,4-benzenetriyl).

The n-valent group represented by A includes those having a substituent such as a hydroxyl or alkyl group or a halogen atom: examples thereof include 1,2-dihydroxyethylene, hydroxyethylene, 2-hydroxy-1,2,3-propanetriyl, methyl-p-phenylene, 1-hydroxy-2-chloroethylene, chloromethylene and chloroethenylene.

The following are typical examples of the compound represented by Formula [II]:

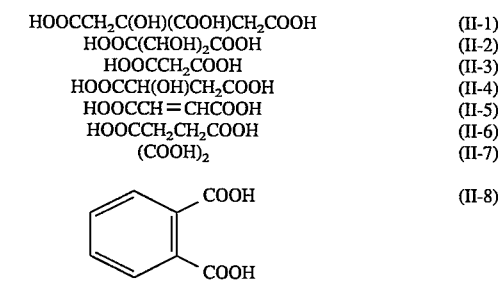

$HOOCCH_2C(OH)(COOH)CH_2COOH$ (II-1)
$HOOC(CHOH)_2COOH$ (II-2)
$HOOCCH_2COOH$ (II-3)
$HOOCCH(OH)CH_2COOH$ (II-4)
$HOOCCH{=}CHCOOH$ (II-5)
$HOOCCH_2CH_2COOH$ (II-6)
$(COOH)_2$ (II-7)
COOH COOH (II-8)

-continued

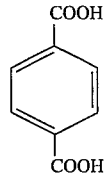
(II-9)

$NaOOCCH{=}CHCOONa$ (II-10)

$KOOCCH{=}CHCOOK$ (II-11)

$H_4NOOCCH{=}CHCOONH_4$ (II-12)

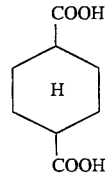
(II-13)

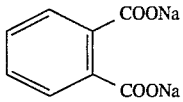
(II-14)

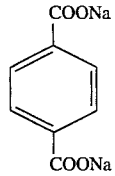
(II-15)

$HOOC{-}(CH_2)_3{-}COOH$ (II-16)

$HOOC{-}(CH_2)_4{-}COOH$ (II-17)

$HOOCC{\equiv}CCOOH$ (II-18)

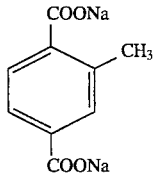
(II-19)

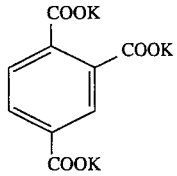
(II-20)

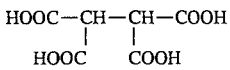
(II-21)

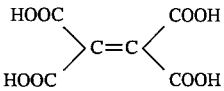
(II-22)

$HO{-}CH_2{-}COOH$ (II-23)

Among the above exemplified compounds, preferred ones are those denoted by [II-1], [II-3], [II-4], [II-5], [II-16], [II-18], [II-23]; the particularly preferred one is that denoted by [II-5].

The compound represented by Formula [II] is used in an amount of preferably 0.05 to 2 mol, especially 0.2 to 1.0 mol per liter of processing solution.

In the invention, a used bleach or bleach-fixer is regenerated by addition of a regenerant and reused as a regenerated bleach or bleach-fixer. Components (e.g., silver ions) accumulated in a used processing solution may be removed or decreased by the usual methods such as the steel wool method disclosed in Japanese Pat. O.P.I. Pub. No. 3624/1973, U.S. Pat. No. 4,065,313, the electrolytic method disclosed in U.S. Pat. Nos. 4,014,764, 4,036,715, Japanese Pat. Exam. Pub. No. 40490/1978, Japanese Pat. O.P.I. Pub. No. 232452/1986, and the dilution method disclosed in Japanese Pat. Exam. Pub. No. 33679/1981. Or a used processing solution may be reused as a regenerated replenisher after it is regenerated by merely adding a regenerant, without being subjected to the above removal treatment. For the bleach-fixer, it is preferable to remove silver when recovery of silver is important; or it is preferable to reuse a regenerated bleach(-fixer) or replenisher by only adding a regenerant without desilverization when simplicity of processing is the first consideration.

As a rule, the regenerant is added to an overflown liquid to compensate for the components lost in the bleach-fixing process.

Preferably, the regenerant used in the invention comprises the same bleaching agent, fixing agent and preservative as those used in the bleach or the bleach-fixer and, if necessary, a bleach accelerator, a rehalogenating agent, a pH buffer and a small amount of an acid.

When the bleach or bleach-fixer is used without taking such a removal means, influence is liable to occur due to the accumulation of developer components brought from the preceding developing bath. In the invention, though such an unwanted influence could be reduced beyond expectation, it is preferable to add a small amount of an acid to the overflown liquid to further minimise such an unwanted influence.

As acid contained in the regenerant, any organic or inorganic acid can be used, but hydrochloric acid, nitric acid and acetic acid are particularly preferred in obtaining adequate effects of the invention. The addition amount thereof is usually 1 to 30 grams per liter of regenerated replenisher; preferably, these acids are used in an amount necessary to adjust the pH of a regenerated replenisher to 4.0 to 6.0.

For the same reason, the amount of the bleaching agent used as a regenerant component is usually 0.1 to 50 grams, preferably 1 to 50 grams per liter of regenerated replenisher or overflown liquid.

In practice, a used bleach or bleach-fixer (overflow) is collected in a tank, and when it reaches a certain volume, the regenerant is added thereto to make it a replenisher. The overflow can be recycled any number of times, and if necessary, it may be subjected to the above treatment for removing accumulated components after repeating a prescribed number of regenerations.

The color photographic light-sensitive material, to which the processing method of the invention is applied, is described hereunder.

The light-sensitive material suitable for the method of the invention includes those used as color negative films, color paper and color reversal films. And, in the embodiment of the invention, desirable color negative films are those comprising silver iodobromide grains having an average silver iodide content of 3 mol %; a more desirable average silver iodide content is 4 to 15 mol %; an even more desirable silver iodide content is 5 to 12 mol %; and the most desirable average silver iodide content is 8 to 11 mol %.

The light-sensitive material for color negative films used in the invention may employ the silver halide emulsions described in Research Disclosure No. 308119 (hereinafter abbreviated as RD308119). Locations of relevant descriptions are shown below.

| [Item] | [Page of RD308119] |
|---|---|
| Iodide structure | 993 Sec. I-A |
| Preparation process | 933 Sec. I-A and 994 Sec. E |
| Crystal habit Regular crystal | 993 Sec. I-A |
| Twin crystal | 993 Sec. I-A |
| Epitaxial | 993 Sec. I-A |
| Halogen composition (Uniform) | 993 Sec. I-B |
| Halogen composition (Not uniform | 993 Sec. I-B |
| Halogen conversion | 994 Sec. I-C |
| Halogen replacement | 994 Sec. I-C |
| Metals contained | 994 Sec. I-D |
| Monodispersion | 995 Sec. I-F |
| Solvent addition | 995 Sec. I-F |
| Latent image forming position (Surface) | 995 Sec. I-G |
| Latent image forming position (Inside) | 995 Sec. I-G |
| Light-sensitive material Negative | 995 Sec. I-H |
| Light-sensitive material Positive (containing internally fogged grains) | 995 Sec. I-H |
| Use of emulsions as a mixture | 995 Sec. I-J |
| Desalting | 995 Sec. II-A |

In the invention, silver halide emulsions are subjected to physical ripening, chemical ripening and spectral sensitization and then used. In these processes, there can be used the additives described in Research Disclosure Nos. 17643, 18716 and 308119 (hereinafter abbreviated as RD17643, RD18716 and RD308119, respectively).

Locations of relevant descriptions are as follows:

| [Item] | [Page of RD308119] | [RD17643] | [RD18716] |
|---|---|---|---|
| Chemical sensitizer | 996 Sec. III-A | 23 | 648 |
| Spectral sensitizer | 996 Sec. IV-A,B,C,D,E,H,I,J | 23–24 | 648–9 |
| Supersensitizer | 996 Sec. IV-A–E,J | 23–24 | 648–9 |
| Antifoggant | 998 VI | 24–25 | 649 |
| Stabilizer | 998 VI | 24–25 | 649 |

Conventional photographic additives usable in the invention are also described in the above Research Disclosures. Locations of relevant descriptions are as follows:

| [Item] | [Page of RD308119] | [RD17643] | [RD18716] |
|---|---|---|---|
| Anti-color-mixing agent | 1002 Sec. VIII-I | 25 | 650 |
| Dye image stabilizer | 1001 Sec. VII-J | 25 | — |
| Whitening agent | 998 V | 24 | — |
| UV absorbent | 1003 Sec. VIII-C Sec. XIII-C | 25–26 | — |
| Light absorbent | 1003 VIII | 25–26 | — |
| Light scattering agent | 1003 VIII | — | — |
| Filter dye | 1003 VIII | 25–26 | — |
| Binder | 1003 IX | 26 | 651 |
| Antistatic agent | 1006 XIII | 27 | 650 |
| Hardener | 1004 X | 26 | 651 |
| Plasticizer | 1006 XII | 27 | 650 |
| Lubricant | 1006 XII | 27 | 650 |
| Surfactant, coating aid | 1005 XI | 26–27 | 650 |
| Matting agent | 1007 XVI | — | — |
| Developer (contained in 1011 Sec. XX-B light-sensitive material) | | | |

Various couplers can be used in the light-sensitive material usable in the invention. Typical examples of such couplers are also described in the above Research Disclosures. Locations of relevant descriptions are as follows:

| [Item] | [Page of RD308119] | [RD17643] [RD18716] |
|---|---|---|
| Yellow coupler | 1001 Sec. VII-D | Sec. VII-C–G |
| Magenta coupler | 1001 Sec. VII-D | Sec. VII-C–G |
| Cyan coupler | 1001 Sec. VII-D | Sec. VII-C–G |
| DIR coupler | 1001 Sec. VII-F | Sec. VII-F |
| BAR coupler | 1002 Sec. VII-F | — |
| Other useful group releasing coupler | 1001 Sec. VII-F | — |
| Alkali-soluble coupler | 1001 Sec. VII-E | — |

The additives used in the invention can be added by the dispersing method or the like described in XIV of RD308119.

The light-sensitive material usable in the invention can employ the supports described on page 28 of RD17643, pages 647–8 of RD18716 and in XIX of RD308119.

In the light-sensitive material usable in the invention, there may be provided auxiliary layers such as a filter layer and an intermediate layer described in Section VII-K in RD308119. Further, the light-sensitive material may have various layer configurations, such as conventional layer order, inverted layer order and unit layer structure described in Section VII-K in RD308119.

The light-sensitive material for color paper processable according to the invention is described hereunder.

As silver halide grains contained in such a light-sensitive material, there are used silver chloride rich silver halide grains containing at least 80 mol % silver chloride. This silver chloride content is desirably not less than 90 mol %, more desirably not less than 95 mol % and most desirably not less than 99 mol %.

The above silver chloride rich silver halide emulsion may contain silver bromide and/or silver iodide as other silver halide compositions. In this case, the amount of silver bromide is desirably not more than 20 mol %, more desirably not more than 10 mol % and most desirably not more than 3 mol %; when silver iodide is contained, its amount is desirably not more than 1 mol %, more desirably not more than 0.5 mol % and most desirably zero. Those silver halide grains which contain 50 mol % or more silver chloride only need to be used in at least one silver halide emulsion layer of the light-sensitive material, but it is preferable that these be used in every light-sensitive silver halide emulsion layer.

These silver halide grains may be regular crystals, twins or other types of crystals and may have an arbitrary [1.0.0] plane to [1.1.1] plane ratio. The crystal structure of these silver halide grains may be uniform from the inner part to the outer part, or it may be a core/shell structure in which the inner part and the outer part form different phases respectively. Further, these silver halide grains may be those which form latent images mostly on the surface or those which form latent images mostly inside of grains. Moreover, there may be used tabular silver halide grains (see Japanese Pat. O.P.I. Pub. Nos. 113934/1983 and Japanese Pat. Appl. No. 170070/1984). Besides the above, the silver halide grains disclosed in Japanese Pat. O.P.I. Pub. Nos. 26837/1989, 26838/1989 and 77047/1989 can also be used.

The silver halide grains may be prepared by any of the acid method, the neutral method and the ammoniacal method.

Further, these may also be prepared through steps of making seed grains firstly by the acid method and then growing them to a prescribed grain size by the ammoniacal method which can provide a larger growth rate. In growing silver halide grains, it is preferable to add, with stirring, silver ions and halide ions simultaneously and sequentially in amounts corresponding to the growth rate of silver halide grains while controlling the pH and pAg of the reaction system, as described in Japanese Pat. O.P.I. Pub. No. 48521/1979.

The light-sensitive material to be processed according to the method of the invention contains couplers in its silver halide emulsion layers.

The red-sensitive layer may contain non-diffusible color couplers to form cyan portion color images; namely, phenol-type or a-naphthol-type couplers in general. The green-sensitive layer may contain at least one non-diffusible color coupler to form magenta portion color images; namely, 5-pyrazolone-type or pyrazolotriazole-type couplers in general. The blue-sensitive layer may contain non-diffusible color couplers to form yellow portion color images; namely, color couplers having an open-chain ketomethylene group. These color couplers may be six-, four- or two-equivalent couplers.

In the invention, two-equivalent couplers are particularly preferred.

Suitable couplers are disclosed, for example, in Farbkuppler by W. Pelz in Mitteilunglnausden Forschungslaboratorien der Agfa, Leverkusen/Munchen, Vol. III, p. 111 (1961); The Chemistry of Synthetic Dyes by K. Venkataraman, Vol. 4, pp. 341–387, Academic Press; The Theory of the Photographic Process, 4th Ed., pp. 353–362; and Research Disclosure No. 17643, Sec. VII.

From a viewpoint of the effect of the invention, preferred color couplers include the magenta couplers represented by Formula [M-1] on page 26 of the specification of Japanese Pat. O.P.I. Pub. No. 106655/1988 (typical examples are those shown on pages 29–34 of the same specification by serial numbers of 1 to 77); the cyan coupler represented by Formula [C-1] or [C-2] on page 34 of the specification {typical examples are those shown on pages 37–42 of the specification by (C'-1) to (C'-82) and (C"-1) to (C"-36)}; and the high-speed yellow coupler described on page 20 of the specification {typical examples are those shown on pages 21-26 of the specification by (Y'-1) to (Y'-39)}.

In order to attain the objects of the invention more effectively, it is preferable to use a magenta coupler represented by the following formula [M-I] in the color light-sensitive material relevant to the invention.

Formula [M-I]

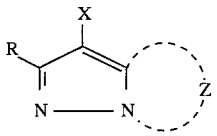

In the magenta coupler having the above formula, Z represents a group of non-metal atoms necessary to form a nitrogen-containing heterocycle, which may have a substituent. X represents a hydrogen atom or a group capable of splitting off upon reaction with an oxidation product of a color developing agent. And R represents a hydrogen atom or a substituent.

In Formula [M-I], the substituent represented by R is not necessarily limited to specified ones, but it is typically an alkyl, aryl, anilino, acylamino, sulfonamido, alkylthio, arylthio, alkenyl or cycloalkyl group. Besides the above, it may also be a halogen atom, a cycloalkenyl, alkynyl, heterocyclic, sulfonyl, sulfinyl, phosphonyl, acyl, carbamoyl, sulfamoyl, cyano, alkoxy, aryloxy, heterocycloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl or heterocyclothio group, a spiro-compound residue, or a bridged hydrocarbon compound residue.

Preferred ranges and typical examples of the substituent represented by R, those of the group capable of splitting off upon reaction with an oxidation product of a color developing agent, those of the nitrogen-containing heterocycle and those of the substituent which the ring formed by Z may have as well as preferred ranges of the magenta dye represented by Formula [M-I], are the same as those described from the 23rd line of page 5 through the 5th line of page 8 of the specification of No. 0327272.

The following are typical examples of the magenta coupler represented by Formula [M-I]:

M-1

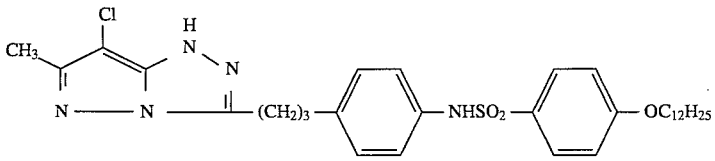

M-2

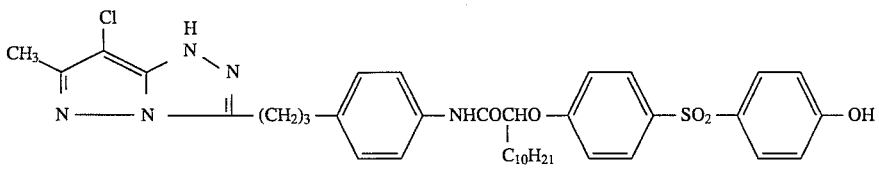

M-3

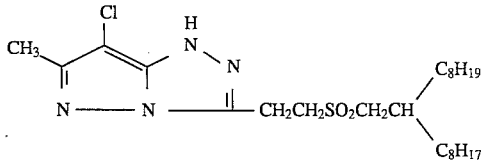

-continued
M-4
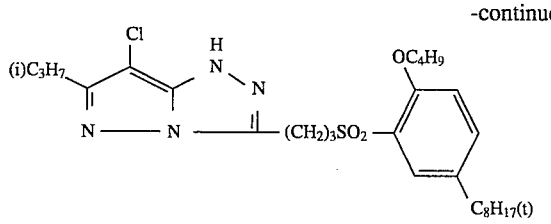
M-5
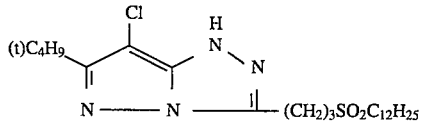
M-6
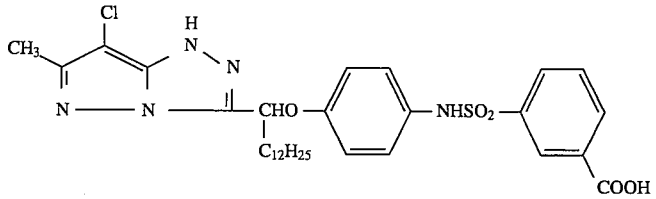
M-7
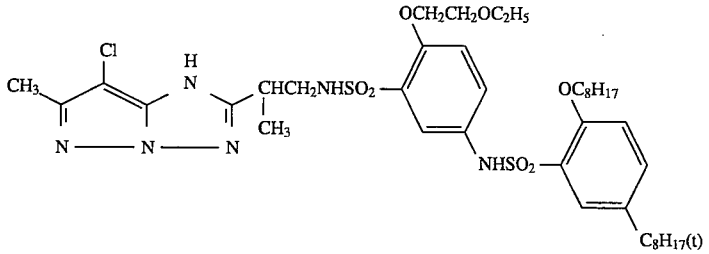
M-8
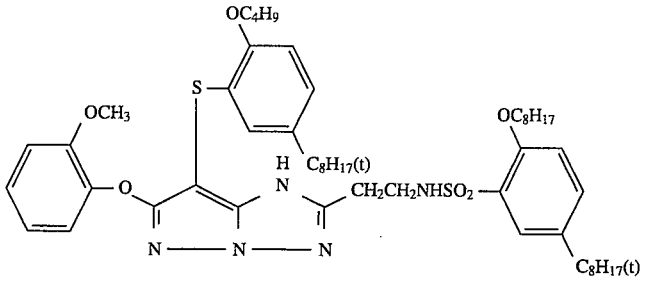
M-9
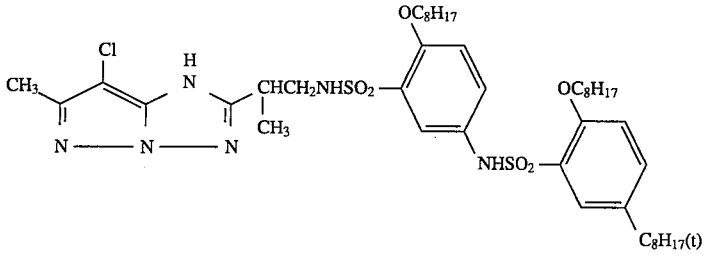
M-10
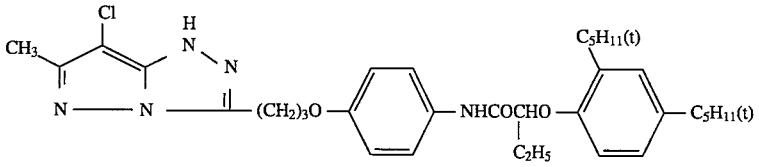
M-11
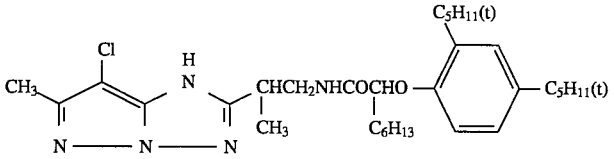

-continued

M-12

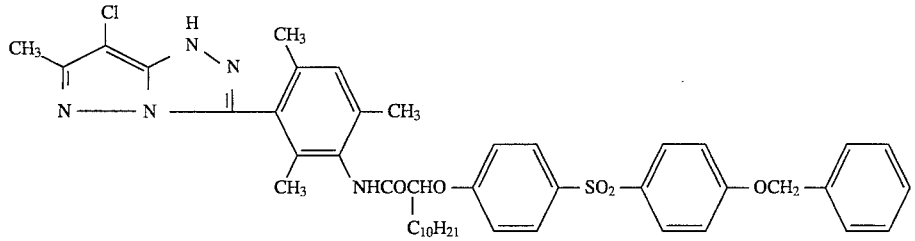

M-13

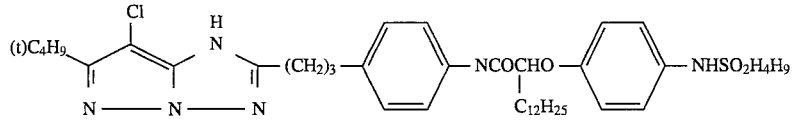

Besides the above typical examples, other examples of the compound according to the invention include the compounds of numbers 13, 34, 42, 57–59, 61–62, 65–67 selected from those described on pages 63–82 of the specification of Japanese Pat. Appl. No. 218720/1990; the compounds denoted by numbers 3, 5–20, 22–33, 35–60, 62–77 among those described on pages 10–28 of the specification of No. 0327272; and the compounds denoted by numbers 1–4, 6, 8–17, 19–24, 26–43, 45–59, 61–104, 106–121, 123–162, 164–223 on pages 36–92 of the specification of No. 0235913.

The foregoing couplers can be synthesized according to the methods described in Journal of the Chemical Society, Perkin I (1977), pp. 2047–2052, U.S. Pat. No. 3,725,067, Japanese Pat. O.P.I. Pub. Nos. 99437/1984, 42045/1983, 162548/1984, 171956/1984, 33552/1985, 43659/1985, 172982/1985, 190779/1985, 209457/1987 and 307453/1988.

These couplers can be used, singly or together with other types of magenta couplers, in amounts of $1\times10^{-3}$ to 1 mole, preferably $1\times10^{-2}$ to $8\times10^{-1}$ mole per mole of silver halide.

Addition of a nitrogen-containing heterocyclic mercapto compound to a light-sensitive material using a silver chloride rich emulsion is one preferable embodiment of the invention, because it not only brings out well the effect of the invention, but also effectively mitigates unwanted influences upon photographic properties when a bleach-fixer is mixed into a color developer.

Suitable examples of such nitrogen-containing heterocyclic mercapto compounds include those exemplified by (I'-1) to (I'-87) on pages 42–45 of the specification of Japanese Pat. O.P.I. Pub. No. 106655/1988.

Silver halide emulsion used in the light-sensitive material relevant to the invention can be prepared by conventional methods (for example, single- or double-Jet injection of materials at a constant or accelerated addition rate). The preferred method comprises double-jet injection of materials at a controlled pAg; see Research Disclosure No. 17643, Secs. I and II.

The silver halide emulsion can be chemically sensitized. Preferred chemical sensitizers are sulfur-containing compounds such as allyl isothiocyanate, allylthiourea and thiosulfates. Reducing agents can also be used as chemical sensitizers; examples thereof include the silver compounds such as those disclosed in Belgian Pat. Nos. 493,464 and 568,687, and polyamines such as diethylenetriamine and aminomethylsulfonic acid derivatives disclosed in Belgian Pat. No. 547,323. Noble metals such as gold, platinum, palladium, iridium, ruthenium and rhodium and compounds thereof are also useful sensitizers for the emulsion. Details of this chemical sensization are described in R. Kosiovsky's article which appeared in Z. Wiss. Photo., Vol. 46, pp. 65–72 (1951), and Research Disclosure No. 17643, Sec. III.

This silver chloride rich emulsion can be spectrally sensitized by conventional methods which use ordinary polymethine dyes such as neutrocyanine, basic or acid carbocyanine, rhodacyanine or hemicyanine, styryl dyes, oxonols or analogues thereof. Details of this spectral sensitization are described in The Cyanine Dyes and Related Compounds by F. M. Hamer, (1964), p. 431, and Research Disclosure No. 17643, Sec. IV.

The silver chloride rich emulsion can use conventional antifoggants and stabilizers. Adeindenes are useful stabilizers; tetra- and penta-adeindene are preferred, and those having a hydroxyl or amino group as substituent are especially preferred. This type of compounds are described in Birr's article in Z. Wiss. Photo., Vol. 47 (1952), pp. 2–58, and Research Disclosure No. 17643, Sec. IV.

The component of the light-sensitive material can be incorporated by the usual method: see U.S. Pat. Nos. 2,322,027, 2,533,514, 3,689,271, 3,764,336 and 3,765,897. Some of the components, such as couplers and UV absorbents, can also be incorporated in the form of charged latices: see German Offenlegungshrift No. 2,541,274 and European Pat. Appl. No. 14,921. Some of the components can be fixed as a polymer in the light-sensitive material: see German Offenlegungshrift No. 2,044,922 and U.S. Pat. Nos. 3,370,952 and 4,080,211.

In the embodiment of the invention, use of a vinylsulfone-type hardener in the light-sensitive material brings out well the effect of the invention.

The vinylsulfone-type hardener is a compound having a vinyl group, or a group capable of forming a vinyl group, bonded with a sulfonyl group; preferred ones are those having at least two vinyl groups, or at least two groups capable of forming vinyl groups, each bonded with a sulfonyl group. Preferred examples thereof are those represented by the following formula [VS-I]:

$$L—(SO_2—X)m \qquad \text{Formula [VS-I]}$$

In Formula [VS-I], L is a m-valent linking group; X is $—CH{=}CH_2$ or $—CH_2CH_2Y$; Y is a group capable of splitting off in the form of HY due to a salt, for example, a halogen atom, a sulfonyloxy or sulfoxy (including salt) group, or a tertiary amine residue; and m is an integer of 2 to 10; when m is 2 or more, $—SO_2—X$'s may be the same or different.

The linking group L is an m-valent group formed by combination of an aliphatic hydrocarbon group (e.g., alkylene, alkylidene, alkylidine or a group formed by bonding thereof) or an aromatic hydrocarbon group (e.g., arylene or a group formed by bonding thereof) with one or more of bonds expressed by —O—, —NR'— (R' is a hydrogen atom, or preferably an alkyl group having 1 to 15 carbon atoms), —S—, —N , —CO—, —SO—, $—SO_2—$ or $—SO_3—$. When a plurality of (—NR'—)s are contained in a linking group L, these (R')'s may bond with each other to form a ring. Further, the linking group L may have a substituent such as a hydroxy, alkoxy, carbamoyl, sulfamoyl, alkyl or aryl group.

Preferred examples of X are $—CH=CH_2$ and $—CH_2CH_2Cl$.

Typical examples of the vinylsulfone-type hardener are shown below.

$$H_2C=CHSO_2CH_2\underset{\underset{OH}{|}}{C}HCH_2SO_2CH=CH_2 \qquad \text{VS-6}$$

$$H_2C=CHSO_2CH_2CONH(CH_2)_2NHCOCH_2SO_2CH=CH_2 \qquad \text{VS-9}$$

$$H_2C=CHSO_2CH_2CONHCH_2CH_2CH_2NHCOCH_2SO_2CH=CH_2 \qquad \text{VS-10}$$

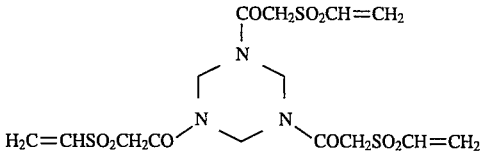

VS-12

$$(H_2C=CHSO_2CH_2)_4C \qquad \text{VS-22}$$

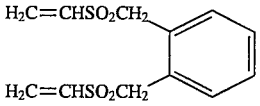

VS-33

$$H_2C=CHSO_2CH_2(CH_2SO_2CH_2CH_2OSO_3^-Na^+)_3 \qquad \text{VS-54}$$

Other examples of the vinylsulfone-type hardener include those exemplified on pages 122–128 of the specification of Japanese Pat. Appl. No. 274026/1990 by (VS-1), (VS-3), (VS-5), (VS-7), (VS-8), (VS-11), (VS-13) to (VS-21), (VS-23) to (VS-32), (VS-34) to (VS-53) and (VS-55) to (VS-57).

These vinylsulfone-type hardeners according to the invention include the aromatic compounds described in German Pat. No. 1,100,942, U.S. Pat. No. 3,490,911; the heteroatom-bonded alkyl compounds described in Japanese Pat. Exam. Pub. Nos. 29622/1969, 25373/1972, 24259/1972; the sulfonamides and esters described in Japanese Pat. O.P.I. Pub. No. 8736/1972; 1,3,5-tris[β-(vinylsulfonyl)-propionyl]hexahydro-s-triazine described in Japanese Pat. O.P.I. Pub. No. 24435/1974; the alkyl compounds described in Japanese Pat. Exam. Pub. No. 35807/1975, Japanese Pat. O.P.I. Pub. No. 44164/1976; and the compounds described in Japanese Pat. O.P.I. Pub. No. 18944/1984.

These vinylsulfone-type hardeners are dissolved in water or in an organic solvent and added to photographic component layers, in a batch mode or an inline addition mode, in amounts of 0.005 to 20 wt %, preferably 0.02 to 10 wt % of binder such as gelatin, etc. The addition of hardeners is not limited to specific photographic component layers; it can be made applicable only to the uppermost layer or the lowermost layer, or to all the layers.

In one preferable embodiment of the invention, a compound represented by the following formula [B-1], [B-2] or [B-3] is contained in the light-sensitive material.

The compound represented by Formula [B-1], [B-2] or [B-3]is described hereunder.

Typical examples of the compound represented by Formula [B-1] are as follows:

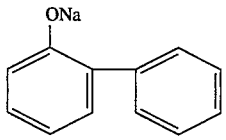

(B-1-1)

-continued

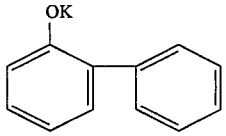

(B-1-2)

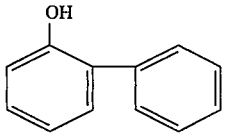

(B-1-3)

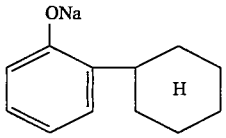

(B-1-16)

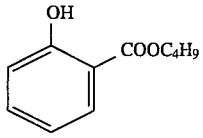

(B-1-18)

Other examples include those exemplified on pages 130–132 of the specification of Japanese Pat. Appl. No. 274026/1990 by (B-1-4) to (B-1-15) and (B-1-17).

Some of the compounds represented by Formula [B-1] are known as antiseptics for citrus fruits and available on the market.

The compound represented by Formula [B-1] is used in amounts of 0.03 to 50 grams, preferably 0.12 to 10 grams and especially 0.15 to 5 grams per liter of the stabilizer of the invention.

Typical examples of the compound represented by Formula [B-2] or [B-3] are as follows, but not limited to them.

(B-2-1) 2-Methyl-4-isothiazoline-3-one
(B-2-2) 5-Chloro-2-methyl-4-isothiazoline-3-one
(B-2-3) 2-Methyl-5-phenyl-4-isothiazoline-3-one
(B-2-4) 4-Bromo-5-chloro-2-methyl-4-isothiazoline-3-one
(B-2-5) 2-Hydroxymethyl-4-isothiazoline-3-one
(B-2-6) 2-(2-Ethoxyethyl)-4-isothiazoline-3-one
(B-2-7) 2-(N-Methyl-carbamoyl)-4-isothiazoline-3-one
(B-2-8) 5-Bromomethyl-2-(N-dichlorophenyl-carbamoyl)-4-isothiazoline-3-one
(B-2-9) 5-Chloro-2-(2-phenylethyl)-4-isothiazoline-3-one
(B-2-10) 4-Methyl-2-(3,4-dichlorophenyl)-4-isothiazoline-3-one
(B-3-1) 1,2-Benzisothiazoline-3-one
(B-3-2) 2-(2-Bromoethyl)-1,2-benzisothiazoline-3-one
(B-3-3) 2-Methyl-1,2-benzisothiazoline-3-one
(B-3-4) 2-Ethyl-5-nitro-1,2-benzisothiazoline-3-one
(B-3-5) 2-Benzyl-1,2-benzisothiazoline-3-one
(B-3-6) 5-Chloro-1,2-benzisothiazoline-3-one Syntheses and uses in other areas of these exemplified compounds are described in U.S. Pat. Nos. 2,767,172, 2,767,173, 2,767,174, 2,870,015, British Pat. No. 848,130, French Pat. No. 1,555,416, etc. Some of them are on the market under the trade names of Topcide 300 (Perma Chem Asia), Topcide 300 (Perma Chem Asia), Finecide J-700 (Tokyo Fine Chemicals Co.) and Proxel GXL (Imperial Chemical Ind. Ltd.).

The compounds represented by Formula [B-1], [B-2] or [B-3] are used, singly or in combination, in the range of 0.1 to 500 mg, preferably 0.5 to 100 mg per square meter of light-sensitive material.

The support of the color light-sensitive material to be processed by the method of the invention may be baryta paper; polyethylene-coated paper; polypropylene synthetic paper; transparent supports, such as glass plates, cellulose acetate film, cellulose nitrate film, polyester film such as polyethylene terephthalate, polyamide film, polycarbonate film, polystyrene film, which have a reflective layer or function as a reflective body by themselves; or other conventional transparent supports.

The invention can be applied to color light-sensitive materials such as color paper, color negative films, color reversal films, color reversal paper and direct positive color paper, which are for general use; films for movie use; and films for TV use.

EXAMPLES

The invention is illustrated by the following Examples, but the embodiment of the invention is not limited to these Examples.

EXAMPLE 1

Preparation of Silver Halide Color Photographic Light-sensitive Material (Color Paper)

A silver halide color photographic light-sensitive material was prepared by forming the following layers on the titanium-oxide-bearing side of a paper support laminated with polyethylene on one side and with titanium-oxide-containing polyethylene on the other side. The coating solutions used were prepared as follows:

Twenty-five grams of yellow coupler (Y-1), 98 g of dye image stabilizer (ST-1), 6.67 g of dye image stabilizer (ST-2) and 0.67 g of additive (HQ-1) were dissolved in 6.67 g of high boiling solvent (DNP) and 60 ml of ethyl acetate. The solution was then dispersed in 220 ml of 10% aqueous solution of gelatin containing 7 ml of 20% surfactant (SU-1) with a supersonic homogenizer to prepare a yellow coupler dispersion. The dispersion was mixed with a blue-sensitive silver halide emulsion (containing 9.8 g of silver) prepared under the following conditions to obtain a coating solution for the 1st layer.

Coating solutions for the 2nd to 7th layers were prepared likewise.

Further, hardener (H-1) was added to the 2nd and 4th layers, and hardener (H-2) to the 7th layer. As coating aids, surfactants (SU-2) and (SU-3) were added to regulate the surface tension.

TABLE 1

| Layer | Component | Amount (g/m$^2$) |
|---|---|---|
| 7th layer (protective layer) | gelatin | 0.8 |
| 6th layer (UV absorbing layer) | gelatin | 0.33 |
| | UV absorbent (UV-1) | 0.10 |
| | UV absorbent (UV-2) | 0.04 |
| | UV absorbent (UV-3) | 0.18 |
| | antistain agent (HQ-1) | 0.01 |

TABLE 1-continued

| Layer | Component | Amount (g/m$^2$) |
|---|---|---|
| | DNP | 0.18 |
| | PVP | 0.03 |
| | anti-irradiation dye (AI-2) | 0.02 |
| 5th layer (red-sensitive layer) | gelatin | 1.21 |
| | red-sensitive silver chlorobromide emulsion (EmC), in terms of Ag | 0.15 |
| | cyan coupler (C-1) | 0.20 |
| | cyan coupler (C-2) | 0.18 |
| | dye image stabilizer (ST-1) | 0.20 |
| | antistain agent (HQ-1) | 0.01 |
| | HBS-1 | 0.20 |
| | DOP | 0.20 |
| 4th layer (UV absorbing layer) | gelatin | 0.70 |
| | UV absorbent (UV-1) | 0.28 |
| | UV absorbent (UV-2) | 0.08 |
| | UV absorbent (UV-3) | 0.38 |
| | antistain agent (HQ-1) | 0.03 |
| | DNP | 0.35 |

TABLE 2

| Layer | Component | Amount (g/m$^2$) |
|---|---|---|
| 3rd layer (green-sensitive layer) | gelatin | 1.40 |
| | green-sensitive silver chlorobromide (green-sensitive emulsion (EmB), in terms of Ag | 0.12 |
| | magenta coupler (M-C) | 0.30 |
| | dye image stabilizer (ST-3) | 0.15 |
| | dye image stabilizer (ST-4) | 0.15 |
| | dye image stabilizer (ST-5) | 0.15 |
| | DNP | 0.20 |
| | anti-irradiation dye (AI-1) | 0.02 |
| 2nd layer (intermediate layer) | gelatin | 1.20 |
| | antistain agent (HQ-2) | 0.19 |
| | DIDP | 0.75 |
| 1st layer (blue-sensitive layer) | gelatin | 1.20 |
| | blue-sensitive silver chlorobromide emulsion (Em A), in terms of Ag | 0.19 |
| | yellow coupler (Y-1) | 0.75 |
| | dye image stabilizer (ST-1) | 0.30 |
| | dye image stabilizer (ST-2) | 0.20 |
| | antistain agent (HQ-1) | 0.02 |
| | anti-irradiation dye (AI-3) | 0.02 |
| | DNP | 0.20 |
| Support | polyethylene laminated paper | |

Y-1
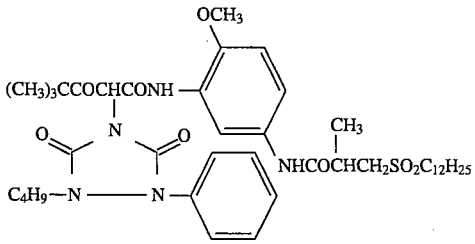
M-C
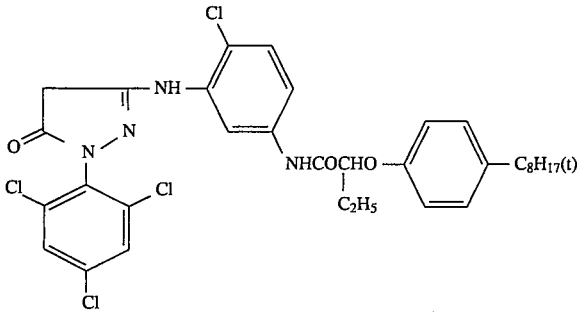
C-1
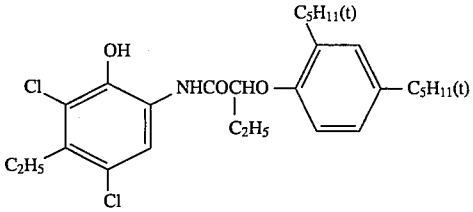
C-2
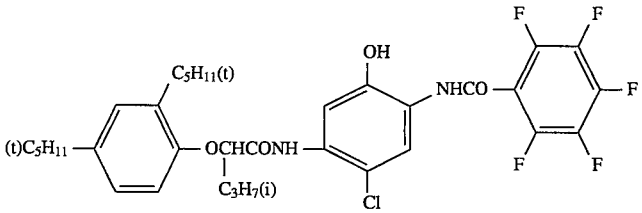
ST-1
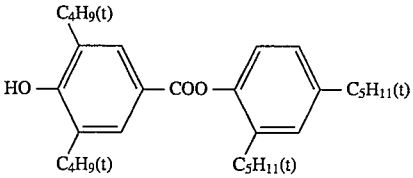
ST-2
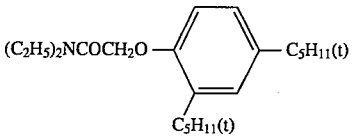
ST-3
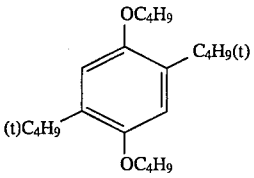
ST-4
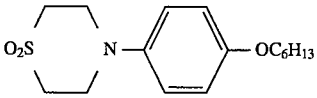

-continued
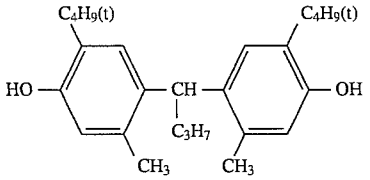
ST-5
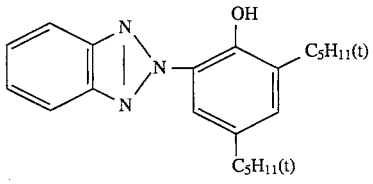
UV-1
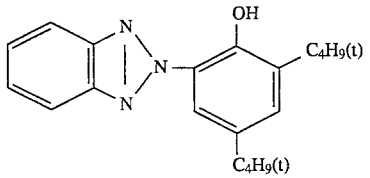
UV-2
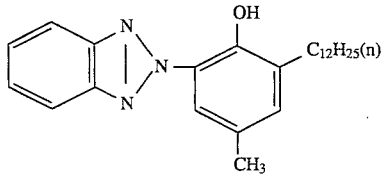
UV-3
| | |
|---|---|
| dioctyl phthalate | DOP |
| dinonyl phthalate | DNP |
| diisodecyl phthalate | DIDP |
| polyvinylpyrrolidone | PVP |
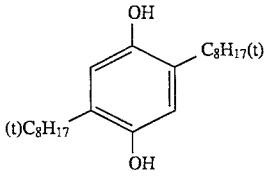
HQ-1
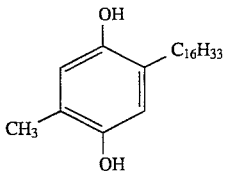
HQ-2
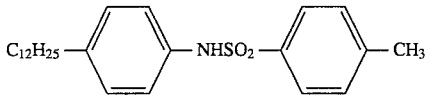
HBS-1
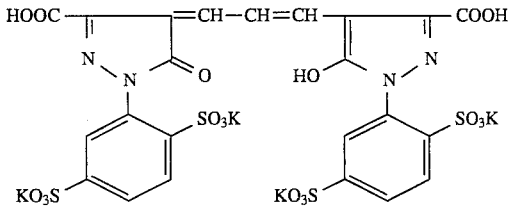
AI-1

-continued

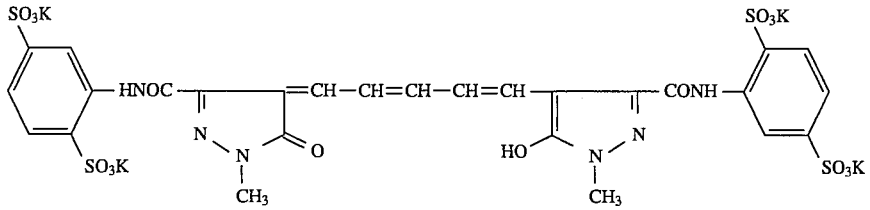

AI-2

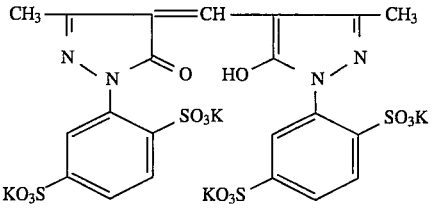

AI-3

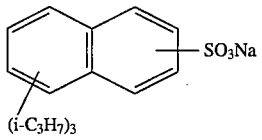

SU-1

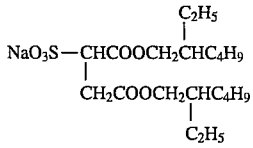

SU-2

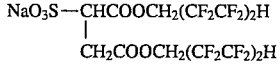

SU-3

H-1

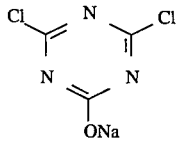

H-2

Preparation of Blue-sensitive Silver Halide Emulsion

The following solutions (A) and (B) were simultaneously added to 1000 ml of 2% aqueous solution of gelatin kept at 40 C. over a period of 30 minutes, while controlling the pAg at 6.5 and the pH at 3.0. Then, the following solutions (C) and (D) were simultaneously added therein over a period of 180 minutes, while controlling the pAg at 7.3 and the pH at 5.5.

The pAg was controlled according to the method described in Japanese Pat. O.P.I. Pub. No. 45437/1984, and that of the pH was controlled by use of sulfuric acid or an aqueous solution of sodium hydroxide.

| | |
|---|---|
| Solution (A) | |
| Sodium chloride | 3.42 g |
| Potassium bromide | 0.03 g |
| Water was added to make | 200 ml |
| Solution (B) | |
| Silver nitrate | 10 g |
| Water was added to make | 200 ml |
| Solution (C) | |
| Sodium chloride | 102.7 g |
| Potassium bromide | 1.0 g |
| Water was added to make | 600 ml |

-continued

| | |
|---|---|
| Solution (D) | |
| Silver nitrate | 300 g |
| Water was added to make | 600 ml |

After completing the addition, the resulting silver halide grains were subjected to desalting using a 5% aqueous solution of Demol N made by Kao Atlas Co. and a 20% aqueous solution of magnesium sulfate and, then, mixed with an aqueous solution of gelatin. Emulsion EMP-1 thus obtained comprised monodispersed cubic grains having an average grain size of 0.85 μm, a coefficient of variation of grain size distribution of 7% and a silver chloride content of 99.5 mol %.

Blue-sensitive silver halide emulsion (Em-A) was prepared by subjecting emulsion EMP-1 to chemical sensitization for 90 minutes at 50° C. using the following compounds:

| | |
|---|---|
| Sodium thiosulfate | 0.8 mg/mol AgX |
| Chloroauric acid | 0.5 mg/mol AgX |
| Stabilizer (STAB-1) | $6 \times 10^{-4}$ mol/mol AgX |
| Sensitizing dye (BS-1) | $4 \times 10^{-4}$ mol/mol AgX |
| Sensitizing dye (BS-2) | $1 \times 10^{-4}$ mol/mol AgX |

Preparation of Green-sensitive Silver Halide Emulsion

There was prepared emulsion EMP-2 comprising monodispersed cubic grains having an average grain size of 0.43 μm, a coefficient of variation of grain size distribution of 8% and a silver chloride content of 99.5 mol %, in the same manner as emulsion EMP-1, except that the addition time of solutions (A) and (B) as well as that of solutions (C) and (D) were changed.

Green-sensitive silver halide emulsion (Em-B) was prepared by subjecting emulsion EMP-2 to chemical sensitization for 120 minutes at 55° C. using the following compounds:

| | |
|---|---|
| Sodium thiosulfate | 1.5 mg/mol AgX |
| Chloroauric acid | 1.0 mg/mol AgX |
| Stabilizer (STAB-1) | $6 \times 10^{-4}$ mol/mol AgX |
| Sensitizing dye (BS-1) | $4 \times 10^{-4}$ mol/mol AgX |

Preparation of Red-sensitive Silver Halide Emulsion

There was prepared emulsion EMP-3 comprising monodispersed cubic grains having an average grain size of 0.50 μm, a coefficient of variation of grain size distribution of 8% and a silver chloride content of 99.5 mol % as emulsion EMP-1, except that the addition time of solutions (A) and (B) as well as that of solutions (C) and (D) were changed.

Red-sensitive silver halide emulsion (Era-C) was prepared by subjecting emulsion EMP-3 to chemical sensitization for 90 minutes at 60° C. using the following compounds:

| | |
|---|---|
| Sodium thiosulfate | 1.8 mg/mol AgX |
| Chloroauric acid | 2.0 mg/mol AgX |
| Stabilizer (STAB-1) | $6 \times 10^{-4}$ mol/mol AgX |
| Sensitizing dye (BS-1) | $4 \times 10^{-4}$ mol/mol AgX |

BS-1

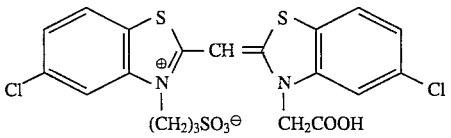

BS-2

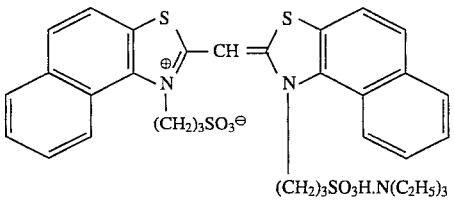

GS-1

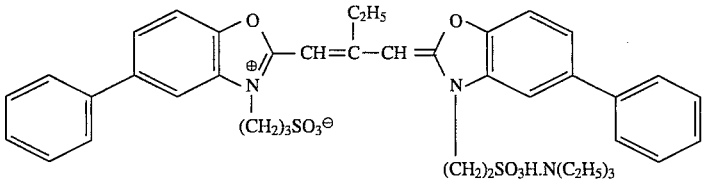

RS-1

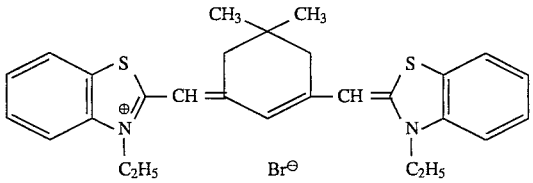

-continued

STAB-1

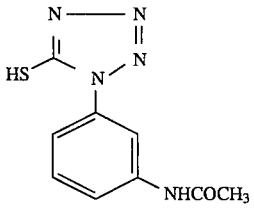

This light-sensitive material sample was exposed according to the usual manner and then processed using the following processes and processing solutions.

| Process | Processing Temp. | Processing Time | Replenishing Rate |
|---|---|---|---|
| (1) Color developing | 40.0 ± 0.3° C. | 20 sec | 55 ml/m$^2$ |
| (2) Bleach-fixing | 40.0 ± 0.5° C. | 25 sec | 60 ml/m$^2$ |
| (3) Stabilizing (three-tank cascade) | 30 to 40° C. | 90 sec | 200 ml/m$^2$ |
| (4) Drying | 60 to 80° C. | 30 sec | — |

| [Color Developer] | |
|---|---|
| Triethanolamine | 10 g |
| Diethylene glycol | 10 g |
| N,N-Diethylhydroxylamine | 3.6 g |
| Hydrazinodiacetic acid | 5.0 g |
| Potassium bromide | 20 mg |
| Potassium chloride | 3.5 g |
| Diethylenetriaminepentaacetic acid | 5 g |
| Potassium sulfite | 0.2 g |
| Color developing agent (3-methyl-4-amino-N-ethyl-N-(β-methanesulfonamidoethyl)-aniline sulfate) | 5.5 g |
| Potassium carbonate | 25 g |
| Potassium hydrogencarbonate | 5 g |

Water was added to make 1000 ml, and the pH was adjusted to 10.10 with potassium hydroxide or sulfuric acid.

| [Color Developing Replenisher] | |
|---|---|
| Triethanolamine | 14.0 g |
| Diethylene glycol | 12 g |
| N,N-Diethylhydroxylamine | 5 g |
| Hydrazinodiacetic acid | 7.5 g |
| Potassium chloride | 0.1 g |
| Diethylenetriaminepentaacetic acid | 7.5 g |
| Potassium sulfite | 0.3 g |
| Color developing agent (3-methyl-4-amino-N-ethyl-N-(β-methanesulfonamidoethyl)-aniline sulfate) | 11.3 g |
| Potassium carbonate | 30 g |
| Potassium hydrogencarbonate | 1 g |

Water was added to make 1000 ml, and the pH was adjusted to 10.65 with potassium hydroxide or sulfuric acid.

| [Bleach-fixer] | |
|---|---|
| Ferric complex salts of organic acids (see Table 3) | 0.2 mol |
| Ammonium thiosulfate | 100 g |
| Sodium sulfite | 10 g |
| Sodium metabisulfite | 1.5 g |

Water was added to make 1000 ml, and the pH was adjusted to 7.0 with a 25% aqueous ammonia and acetic acid.

Bleach-fixing Replenisher

The concentration of each component was made 1.25 times that of the above bleach-fixer and the pH was adjusted to 5.3.

| [Stabilizer and Stabilizing Replenisher] | |
|---|---|
| Ortho-phenylphenol | 0.1 g |
| MST (a stilbene diphosponic acid derivative product of Ciba-Geigy AG) | 1.0 g |
| ZnSO4 | 0.8 g |
| Ammonium sulfite (40% solution) | 5.0 ml |
| 1-Hydroxyethylidene-1,1-diphosphonic acid (60% solution) | 10 g |
| Ethylenediaminetetracetic acid | 1.5 g |

The pH was adjusted to 7.8 with aqueous ammonia or sulfuric acid and water was added to make 1000 ml.

The overflown liquid of the bleach-fixer was collected in a tank; when the tank was filled with the overflown liquid, the regenerant of the following recipe (addition amounts are for 1000 ml of overflow) was added to it. The regenerated overflow was then reused as replenisher.

| [Regenerant] | |
|---|---|
| Ferric complex salts of organic acids (see Table 3) | 0.052 mol |
| Ammonium thiosulfate | 30 g |
| Sodium sulfite | 15 g |

The pH was adjusted to 5.3 with acetic acid.

The continuous processing was run until the above regenerating process was repeated 30 times.

After the processing, the processed sample was subjected to X-ray fluorescence analysis to determine the residual amount of silver in the exposed portion; it was further checked visually for stains on edge portions. The bleach-fixer tank solution after the processing was visually checked for possible sulfide formation. The evaluation results are shown in Table 3.

In Table 3, the letters in the column of sulfide formation have the following meanings:

A: no sulfides are observed at all.

B: very slight floating matters are observed on the liquid surface.

C: faint formation of sulfides is observed.

D: obvious formation of sulfides is observed.

E: heavy formation of sulfides are observed.

The letters in the column of edge stain have the following meanings:

A: no edge stains are observed at all.

B: very slight edge stains are observed.

C: slight edge stains are observed.

D: obvious edge stains are observed.

E: heavy edge stains are observed.

TABLE 3

| Experiment No. | Ferric Complex Salt of Organic Acid | Amount of Residual Silver (mg/100 cm$^2$) | Edge Stain | Formation of Sulfides | Remarks |
|---|---|---|---|---|---|
| 1-1 | EDTA-Fe | 1.0 | C | D | Comparison |
| 1-2 | PDTA-Fe | 2.1 | C | E | Comparison |
| 1-3 | DTPA-Fe | 0.6 | E | B | Comparison |
| 1-4 | NTA-Fe | 1.5 | C | D | Comparison |
| 1-5 | CyDTA-Fe | 1.3 | C | D | Comparison |
| 1-6 | (A-I-1)-Fe | 0.6 | B | B | Invention |
| 1-7 | (A-I-2)-Fe | 0.6 | B | B | Invention |
| 1-8 | (A-II-1)-Fe | 0.4 | A | A | Invention |
| 1-9 | (A-II-3)-Fe | 0.3 | A | A | Invention |
| 1-10 | (A-II-14)-Fe | 0.4 | A | A | Invention |
| 1-11 | (A-III-1)-Fe | 0.6 | B | B | Invention |
| 1-12 | (A-III-2)-Fe | 0.7 | B | B | Invention |
| 1-13 | (A-III-6)-Fe | 0.7 | B | B | Invention |

In Table 3 and the tables that follow, EDTA-Fe is ammonium ferric ethylenediaminetetraacetate; PDTA-Fe, ammonium ferric 1,3-propylenediaminetetraacetate; DTPA-Fe, ammonium ferric diethylenetriaminepentaacetate; NTA-Fe, ammonium ferric nitrilotriacetate; CyDTA-Fe, ammonium ferric cyclohexanetetracetate; (A-I-1)-Fe represents ammonium ferric complex salt of exemplified compound (A-I-1), and (A-I-2)-Fe, (A-II-1)-Fe, (A-II-3) -Fe, (A-II-14) -Fe, (A-III-1) -Fe, (A-III-2)-Fe and (A-III-6)-Fe each have the same meaning.

It can be understood from Table 3 that use of the ferric complex salt of organic acids according to the invention provides an image low in residual silver and less in edge staining as well as an improved preservability of a bleach-fixer.

EXAMPLE 2

In the following examples, addition amounts in a silver halide light-sensitive material are in grams per square meter unless otherwise indicated. Amounts of silver halides and colloidal silvers are given in amounts of silver present. A silver iodobromide color photographic light-sensitive material was prepared in the following way. Silver Iodobromide Color Photographic Light-sensitive Material A 60-μm thick polyethylene terephthalate film support was subbed on one side. Then, the following two layers were formed in order on the support opposite to the subbed side (on the unsubbed side).

| | |
|---|---|
| Reverse 1st layer | |
| Alumina Sol AS-100 (aluminium oxide made by Nissan Chemical Ind.) | 0.8 g |
| Reverse 2nd layer | |
| Diacetylcellulose | 100 mg |
| Stearic acid | 10 mg |
| Silica fine powder (average particle size: 0.2 μm) | 50 mg |

Subsequently, multilayered color photographic light-sensitive material (a-1) was prepared by forming the following layers in order on the subbed side of the support.

| | |
|---|---|
| 1st layer: antihalation layer (HC) | |
| Black colloidal silver | 0.15 g |

-continued

| | |
|---|---|
| UV absorbent (UV-1) | 0.20 g |
| Colored cyan coupler (CC-1) | 0.02 g |
| High boiling solvent (Oil-1) | 0.20 g |
| High boiling solvent (Oil-2) | 0.20 g |
| Gelatin | 1.6 g |
| 2nd layer: intermediate layer (IL-1) | |
| Gelatin | 1.3 g |
| 3rd layer: low-speed red-sensitive emulsion layer (R-1) | |
| Silver iodobromide emulsion (average grain size: 0.3 μm) | 0.4 g |
| Silver iodobromide emulsion (average grain size: 0.4 μm) | 0.3 g |
| Sensitizing dye (S-1) | $3.0 \times 10^{-4}$ (mol/mol Ag) |
| Sensitizing dye (S-2) | $3.2 \times 10^{-4}$ (mol/mol Ag) |
| Sensitizing dye (S-3) | $0.3 \times 10^{-4}$ (mol/mol Ag) |
| Cyan coupler (C-1) | 0.50 g |
| Cyan coupler (C-2) | 0.20 g |
| Colored cyan coupler (CC-1) | 0.07 g |
| DIR compound (D-1) | 0.006 g |
| DIR compound (D-2) | 0.01 g |
| High boiling solvent (Oil-1) | 0.55 g |
| Gelatin | 1.0 g |
| 4th layer: high-speed red-sensitive emulsion layer (R-H) | |
| Silver iodobromide emulsion (average grain size: 0.7 μm) | 0.9 g |
| Sensitizing dye (S-1) | $1.7 \times 10^{-4}$ (mol/mol Ag) |
| Sensitizing dye (S-2) | $1.6 \times 10^{-4}$ (mol/mol Ag) |
| Sensitizing dye (S-3) | $0.2 \times 10^{-4}$ (mol/mol Ag) |
| Cyan coupler (C-2) | 0.23 g |
| Colored cyan coupler (CC-1) | 0.03 g |
| DIR compound (D-2) | 0.02 g |
| High boiling solvent (Oil-1) | 0.30 g |
| Gelatin | 1.0 g |
| 5th layer: intermediate layer (IL-2) | |
| Gelatin | 0.8 g |
| 6th layer: low-speed green-sensitive emulsion layer (G-L) | |
| Silver iodobromide emulsion (average grain size: 0.4 μm) | 0.6 g |
| Silver iodobromide emulsion (average grain size: 0.3 μm) | 0.2 g |
| Sensitizing dye (S-4) | $6.7 \times 10^{-4}$ (mol/mol Ag) |
| Sensitizing dye (S-5) | $1.0 \times 10^{-4}$ (mol/mol Ag) |
| Magenta coupler (M-A) | 0.20 g |
| Magenta coupler (M-B) | 0.40 g |
| Colored magenta coupler (CM-1) | 0.10 g |
| DIR compound (D-3) | 0.02 g |
| High boiling solvent (Oil-2) | 0.7 g |
| Gelatin | 1.0 g |
| 7th layer: high-speed green-sensitive emulsion layer (G-H) | |
| Silver iodobromide emulsion (average grain size: 0.7 μm) | 0.9 g |
| Sensitizing dye (S-6) | $1.1 \times 10^{-4}$ (mol/mol Ag) |
| Sensitizing dye (S-7) | $2.0 \times 10^{-4}$ (mol/mol Ag) |
| Sensitizing dye (S-8) | $0.5 \times 10^{-4}$ (mol/mol Ag) |
| Magenta coupler (M-A) | 0.5 g |
| Magenta coupler (M-B) | 0.13 g |
| Colored magenta coupler (CM-1) | 0.04 g |
| DIR compound (D-3) | 0.004 g |
| High boiling solvent (Oil-2) | 0.35 g |
| Gelatin | 1.0 g |
| 8th layer: yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| High boiling solvent (Oil-2) | 0.15 g |
| Gelatin | 0.9 g |
| 9th layer: low-speed blue-sensitive emulsion layer (B-H) | |
| Silver iodobromide emulsion (average grain size: 0.3 μm) | 0.25 g |
| Silver iodobromide emulsion (average grain size: 0.4 μm) | 0.25 g |

-continued

| | |
|---|---|
| Sensitizing dye (S-9) | $5.8 \times 10^{-4}$ (mol/mol Ag) |
| Yellow coupler (Y-1) | 0.71 g |
| Yellow coupler (Y-2) | 0.30 g |
| DIR compound (D-1) | 0.003 g |
| DIR compound (D-2) | 0.006 g |
| High boiling solvent (Oil-2) | 0.18 g |
| Gelatin | 1.2 g |
| 10th layer: high-speed blue-sensitive emulsion layer (B-H) | |
| Silver iodobromide emulsion (average grain size: 0.8 μm) | 0.5 g |
| Sensitizing dye (S-10) | $3 \times 10^{-4}$ (mol/mol Ag) |
| Sensitizing dye (S-11) | $1.2 \times 10^{-4}$ (mol/mol Ag) |
| Yellow coupler (Y-1) | 0.18 g |
| Yellow coupler (Y-2) | 0.20 g |
| High boiling solvent (Oil-2) | 0.05 g |
| Gelatin | 0.9 g |
| 11th layer: 1st protective layer (PRO-1) | |
| Silver iodobromide (average grain size: 0.08 μm) | 0.3 g |
| UV absorbent (UV-1) | 0.07 g |
| UV absorbent (UV-2) | 0.10 g |
| Additive (HS-1) | 0.2 g |

-continued

| | |
|---|---|
| Additive (HS-2) | 0.1 g |
| High boiling solvent (Oil-1) | 0.07 g |
| High boiling solvent (Oil-3) | 0.07 g |
| Gelatin | 0.85 g |
| 12th layer: 2nd protective layer (PRO-2) | |
| Compound A | 0.04 g |
| Compound B | 0.004 g |
| Polymethylmethacrylate (average particle size: 3 μm) | 0.02 g |
| Methyl methacrylate-ethyl methacrylate-methacrylic acid 3:3:4 (weight ratio) copolymer (average particle size: 3 μm) | 0.13 g |

Besides the above components, this color photographic light-sensitive material contained compounds (Su-1) and (Su-2), viscosity regulator, hardeners (H-1) and (H-2), stabilizer (ST-1), antifoggants (AF-1) and (AF-2) having molecular weights of 10,000 and 1,100,000, respectively, dyes (AI-1) and (AI-2), and compound (DI-1) (9.4 mg/m$^2$).

C-1

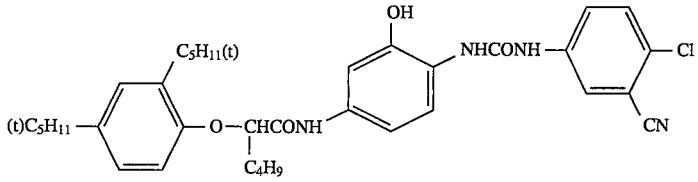

C-2

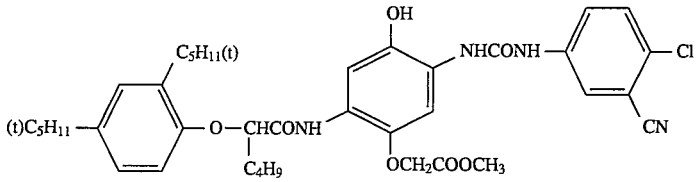

M-A

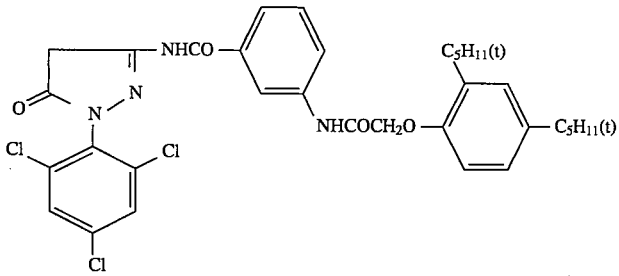

M-B

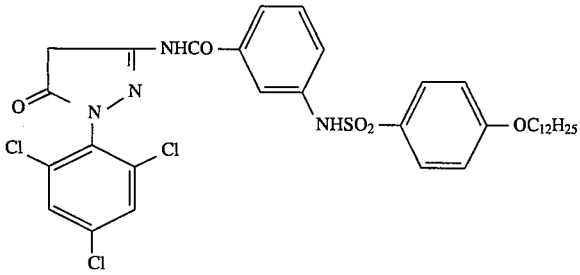

-continued
Y-1
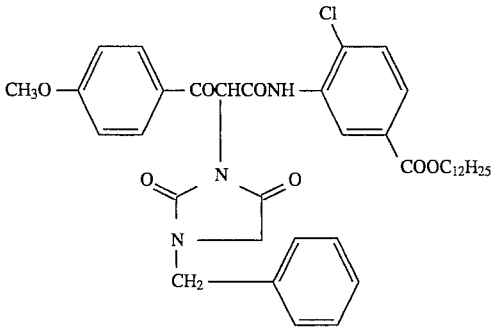
Y-2
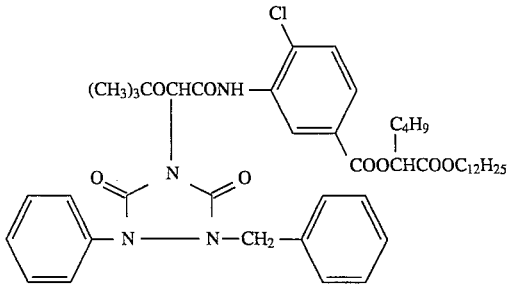
CC-1
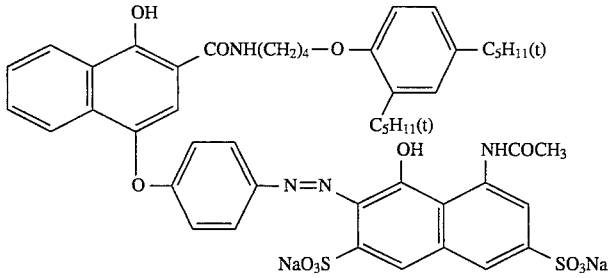
CM-1
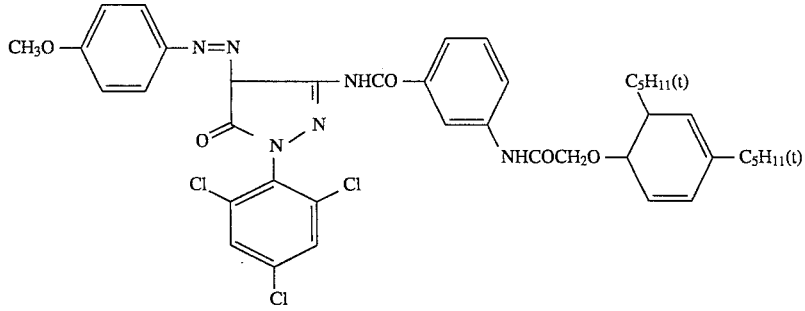
D-1
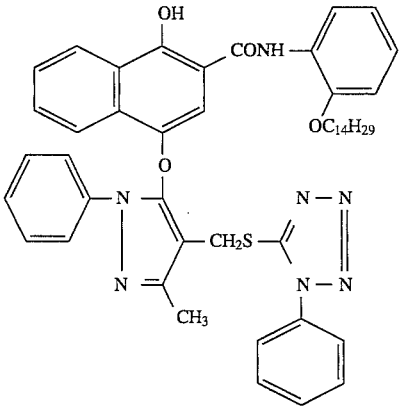

-continued
D-2
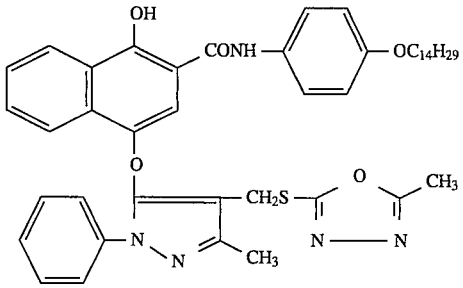
D-3
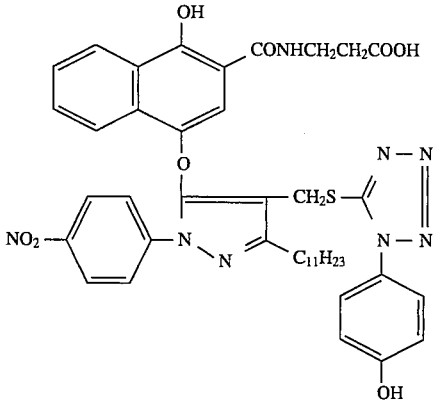
UV-1
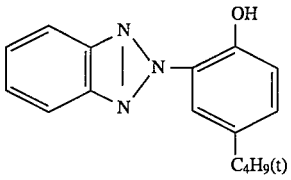
UV-2
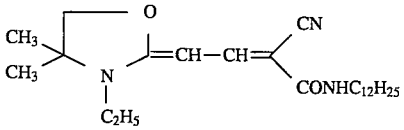
S-1
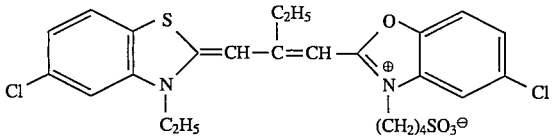
S-2
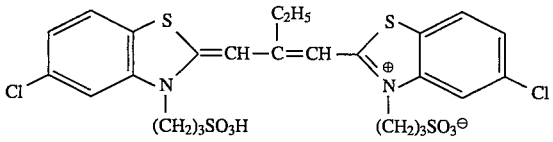
S-3
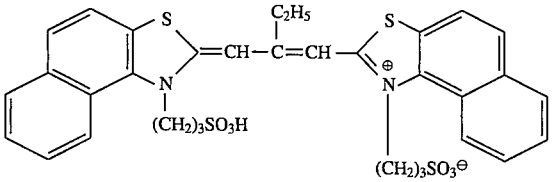
S-4
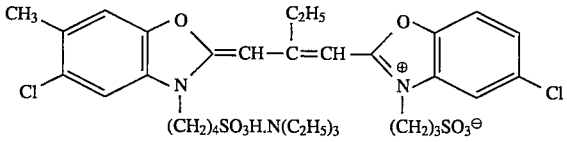

-continued
S-5
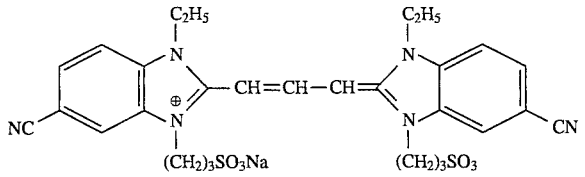
S-6
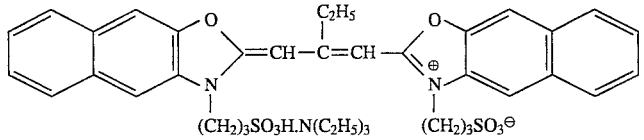
S-7
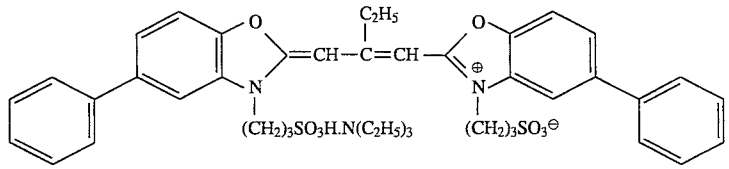
S-8
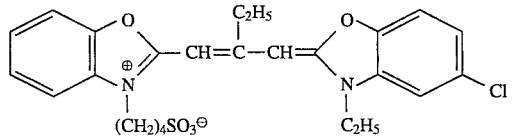
S-9
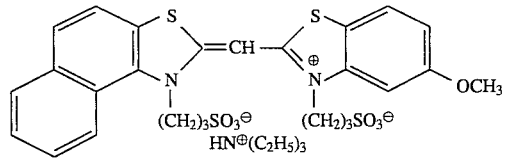
S-10
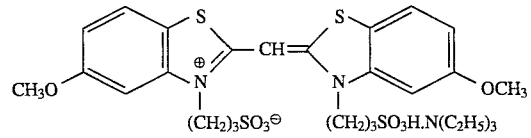
S-11
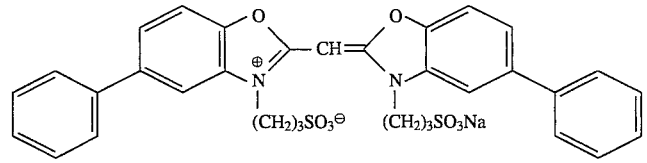
HS-1
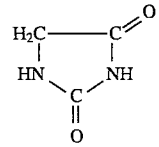
HS-2
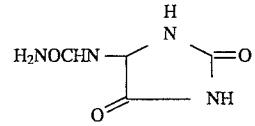
SC-1
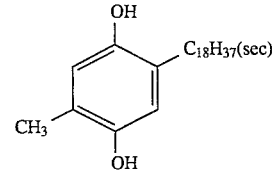
and
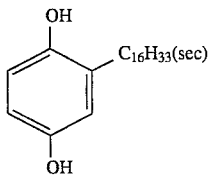
(mixture of 2:3)

-continued
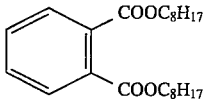
Oil-1
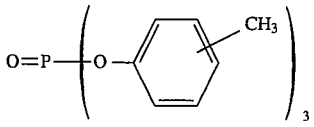
Oil-2
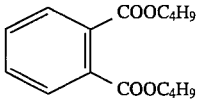
Oil-3
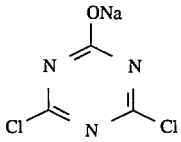
H-1
$(CH_2{=}CHSO_2CH_2)_2O$
H-2
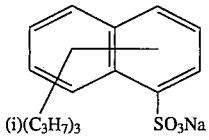
SU-1
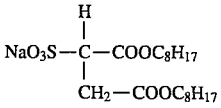
SU-2
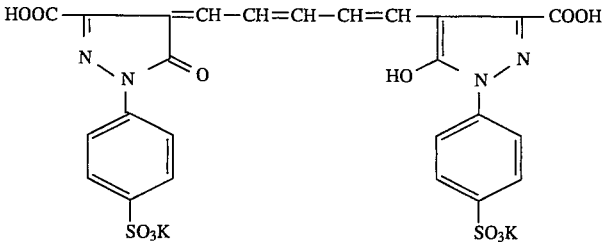
AI-1
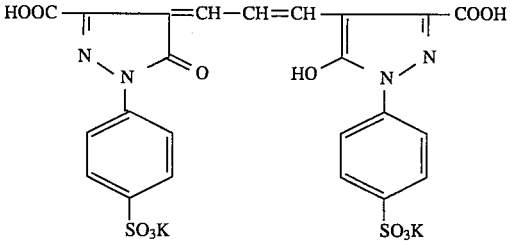
AI-2
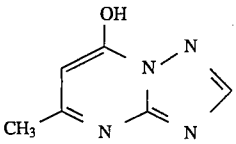
ST-1
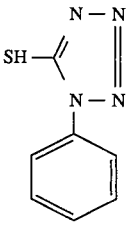
AF-1

-continued

AF-2

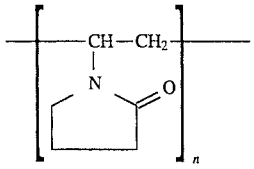

Compound A

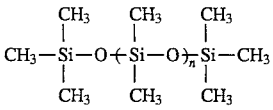

Weight-average molecular weight = 30,000

Compound B $NaO_3S-CH(CH_2-COOCH_2(CF_2CF_2)_3H)-COOCH_2(CF_2CF_2)_3H$

DI-1: a mixture of the following three components

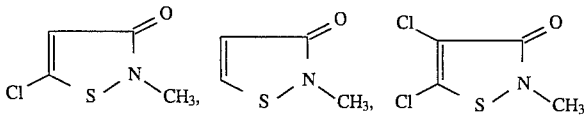

Component A:Component B:Component C = 50:23:20 (molar ratio)

Preparation of Emulsion

The silver iodobromide emulsion used in the 10th layer was prepared in the following manner:

A silver iodobromide emulsion was prepared by the double-jet method using monodispersed silver iodobromide grains having an average grain size of 0.33 μm (silver iodobromide content: 2 mol %) as seed crystal grains.

While stirring solution <G-1> kept at 70° C. pAg 7.8 and pH 7.0, the seed emulsion was added thereto in an amount equivalent to 0.34 mole.

(Formation of Inner High-iodide Phase or Core Phase)

Then, solutions <H-1> and <S-1> were added thereto over a period of 86 minutes, at an accelerated addition rate (the final addition rate was 3.6 times the initial addition rate), with their flow ratio kept at 1:1.

Formation of Outer Low-iodide Phase or Shell Phase

Subsequently, while keeping the pAg at 10.1 and pH at 6.0 solutions <H-2> and <S-2> were added over a period of 65 minutes, at an accelerated addition rate (the final addition rate was 5.2 times the initial addition rate), with their flow ratio kept at 1:1.

During this grain formation, the pAg and pH were controlled by use of an aqueous solution of potassium bromide and 56% aqueous acetic acid. After grains were formed, they were subjected to washing treatment by the usual flocculation method and, then, mixed with gelatin for redispersing. This dispersion was adjusted to pH 5.8 and pAg 8.06 at 40° C.

The resulting emulsion comprised monodispersed octahedral silver iodobromide grains having an average grain size of 0.80 μm, a coefficient of variation of grain size distribution of 12.4% and a silver iodide content of 9.0 mol %.

| Solution <G-1> | |
|---|---|
| Ossein gelatin | 100.0 g |
| 10-wt % Methanol solution of compound-1 | 25.0 ml |

-continued

| | |
|---|---|
| 28% Aqueous ammonia | 440.0 ml |
| 56% Aqueous acetic acid | 660.0 ml |
| Water is added to make | 5000.0 ml |
| Solution <H-1> | |
| Ossein gelatin | 82.4 g |
| Potassium bromide | 151.6 g |
| Potassium iodide | 90.6 g |
| Water is added to make | 1030.5 ml |
| Solution <S-1> | |
| Silver nitrate | 309.2 g |
| 28% Aqueous ammonia equivalent | |
| Water is added to make | 1030.5 ml |
| Solution <H-2> | |
| Ossein gelatin | 302.1 g |
| Potassium bromide | 770.0 g |
| Potassium iodide | 33.2 g |
| Water is added to make | 3776.8 ml |
| Solution <S-2> | |
| Silver nitrate | 1133.0 g |
| 28% Aqueous ammonia equivalent | |
| Water is added to make | 3776.8 ml |

The chemical structure of compound-1 used in solution <G-1> is as follows:

Compound-1

$HO(CH_2CH_2O)_m(CH(CH_3)CH_2O)_{17}(CH_2CH_2O)_nH$ (1300 = approx. average molecular weight)

The above emulsions different in average grain size and silver iodide content were prepared by altering average size of seed crystals, temperature, pAg, pH, addition rate, addition time and halide composition, respectively.

Each resulting emulsion was a core/shell-type monodispersed one having a coefficient of variation of grain size distribution not more than 20%. Each emulsion was subjected to chemical ripening, under optimum conditions, in the presence of sodium thiosulfate, chloroauric acid and ammonium thiocyanate. Then, the sensitizing dyes, 4-hydroxy-6-methyl-1,3,3a,7-tetrazaindene, and 1-phenyl-5-mercaptotetrazole were added thereto.

In the preparation of this silver iodobromide color light-sensitive material, the average silver iodide content was adjusted to 8 mol %.

The light-sensitive material so prepared was exposed wedgewise by the usual method and then subjected to continuous processing in the following procedure:

| Process | Processing Time | Processing Temp. | Replenishing Rate* |
|---|---|---|---|
| Color developing (1 tank) | 3 min 15 sec | 38° C. | 18 ml |
| Bleaching (1 tank) | 60 sec | 38° C. | 4 ml |
| Fixing (1 tank) | 1 min | 38° C. | 15 ml |
| Stabilizing (3-tank cascade) | 1 min | 38° C. | 30 ml |
| Drying 40–80° C. | 1 min | — | — |

| Color Developing Solution | |
|---|---|
| Potassium carbonate | 30 g |
| Sodium hydrogencarbonate | 2.5 g |
| Potassium sulfite | 3.0 g |
| Sodium bromide | 1.3 g |
| Potassium iodide | 0.6 mg |
| Hydroxylamine sulfate | 2.5 g |
| Sodium chloride | 0.6 g |
| 4-Amino-3-methyl-N-ethyl-N-(β-hydroxylethyl) aniline sulfate | 4.5 g |
| Diethylenetriaminepentaacetic acid | 3.0 g |
| Potassium hydroxide | 1.2 g |

*Amounts per roll of film (135 size, 24 exposures)

Water is added to make 1000 ml, and the pH is adjusted to 10.00 with potassium hydroxide or 20% sulfuric acid.

| Color Developing Replenisher | |
|---|---|
| Potassium carbonate | 35 g |
| Sodium hydrogencarbonate | 3 g |
| Potassium sulfite | 5 g |
| Sodium bromide | 0.3 g |
| Hydroxylamine sulfate | 3.5 g |
| 4-Amino-3-methyl-N-ethyl-N-(β-hydroxylethyl) aniline sulfate | 6.0 g |
| Potassium hydroxide | 2 g |
| Diethylenetriaminepentaacetic acid | 3.0 g |

Water was added to make 1000 ml, and the pH was adjusted to 10.20 with potassium hydroxide or 20% sulfuric acid.

| Bleaching Tank Solution | |
|---|---|
| Ferric complex salts of organic acids (described in Table 4) | 0.35 mol |
| Ethylenediaminetetraacetic acid | 2.0 g |
| Ammonium bromide | 1.0 mol |
| Glacial acetic acid | 50 ml |

The pH was adjusted to 4.2 with aqueous ammonia or acetic acid, and then water was added to make 1000 ml.

Bleach-replenisher

The concentration of each component is made 1.2 times that of the bleaching tank solution, and the pH is adjusted to 3.0.

| Fixer (Tank Solution and Replenisher) | |
|---|---|
| Ammonium thiosulfate (70% solution) | 350 ml |
| Ammonium thiocyanate | 20 g |
| Anhydrous sodium bisulfite | 12 g |
| Sodium metabisulfite | 2.5 g |
| Disodium ethylenediaminetetraacetate | 0.5 g |

Water was added to make 1000 ml, and the pH was adjusted to 6.0 with acetic acid and aqueous ammonia.

| Stabilizer (Tank Solution and Replenisher) | |
|---|---|
| Hexamethylenetetramine | 5 g |
| Diethylene glycol | 2 g |
| $p\text{-}C_9H_{19}—C_6H_4—(OCH_2CH_2)_{10}—OH$ | 2 g |

The pH was adjusted to 8.0 with potassium hydroxide, and water was added to make 1000 ml.

The above regenerating procedure was repeated 35 times while running the processing continuously.

After the continuous processing was completed, the amount of residual silver as well as the yellow fog density of unexposed portion on the processed light-sensitive material were examined; formation of sulfides in the fixer was also checked as in Example 1.

The results obtained are shown in Table 4, in which the letters A to E mean the same as those in Table 3.

TABLE 4

| Experiment No. | Ferric Complex Salt of Organic Acid | Amount of Residual Silver (mg/100 cm²) | Yellow Fog Density of Unexposed Portion | Formation of Sulfides in Fixer | Remarks |
|---|---|---|---|---|---|
| 2-1 | EDTA-Fe | 10.5 | 0.05 | C | Comparison |
| 2-2 | PDTA-Fe | 0.5 | 0.27 | E | Comparison |
| 2-3 | DTPA-Fe | 12.6 | 0.04 | B | Comparison |
| 2-4 | NTA-Fe | 6.3 | 0.03 | B | Comparison |
| 2-5 | CyDTA-Fe | 7.1 | 0.04 | B | Comparison |
| 2-6 | (A-I-1)-Fe | 0.6 | 0.03 | A | Invention |
| 2-7 | (A-I-2)-Fe | 0.5 | 0.03 | A | Invention |
| 2-8 | (A-II-1)-Fe | 0.8 | 0.03 | A | Invention |
| 2-9 | (A-II-3)-Fe | 0.8 | 0.04 | A | Invention |
| 2-10 | (A-II-14)-Fe | 0.7 | 0.03 | A | Invention |
| 2-11 | (A-III-1)-Fe | 0.9 | 0.04 | B | Invention |
| 2-12 | (A-III-2)-Fe | 0.8 | 0.03 | B | Invention |
| 2-13 | (A-III-6)-Fe | 0.9 | 0.03 | B | Invention |

It can be understood from Table 4 that use of the organic acid ferric complex salt of the invention exerts favorable effects in reducing the amount of residual silver, controlling the rise in yellow fog density of unexposed portions and improving the preservability of a fixer.

EXAMPLE 3

According to 301C Amended MITI Test (I) adopted on May 12, 1981, by OECD as the guideline for testing chemical substances, biodegradabilities were determined on photographic chelating agents including ethylenediaminetetraacetic acid (EDTA), diethylenetriaminepentaacetic acid (DTPA), N-hydroxyethyl-ethylenediaminetetraacetic acid (HEDTA), and exemplified compounds (A-I-1), (A-I-2), (A-II-1), (A-II-3), (A-II-14), (A-III-1), (A-III-6).

As a result, it was found that while the ferric salts of EDTA, DTPA and HEDTA were hardly decomposed biologically, the ferric salts of the chelating agents according to the invention were highly biodegradable and, thereby, proved to be high in environmental suitability.

EXAMPLE 4

Experiments were carried out in the same manner as in Experiment Nos. 1-6, 1-8 and 1-11 of Example 1, except that magenta coupler (M-C) used in Example 1 was replaced by exemplified magenta couplers (M-5), (M-8), (M-11), (M-9), (M-12), (M-13), (M-7) and (M-4), respectively. The results showed that the amount of residual silver was decreased by 20 to 25%, and that the whiteness of unexposed portions was also improved.

EXAMPLE 5

Experiments were made in the same manner as in Experiment Nos. 2-6, 2-8 and 2-11 of Example 2, except that magenta couplers (M-A) and (M-B) used in Example 2 were replaced by exemplified magenta couplers (M-2), (M-6), (M-8), (M-1), (M-10) and (M-3), respectively. A 20–25% decrease in amount of residual silver and a 40% decrease in yellow fog density were observed.

The overflown liquid of the bleach was collected in a tank. And a regenerant having the following composition (amounts are for 1000 ml of overflown liquid) was added thereto, when the tank was filled with the overflown liquid.

| [Regenerator] | |
|---|---|
| Organic acid ferric complex salt (see Table 4) | 0.05 mol |
| Ethylenediaminetetraacetic acid | 3.0 g |
| Ammonium bromide | 0.08 mol |

The pH was adjusted to 3.0 with acetic acid.

EXAMPLE 6

Experiments were carried out in the same manner as in Experiment Nos. 2-6 and 2-7 of Example 2, except that the ratio of ammonium ions to the total cations contained in the bleach of Example 2 was varied as shown in Table 5 by replacing the cations of the compounds added to the bleach with ammonium ions or potassium ions.

The results are summarized in Table 5.

TABLE 5

| Experiment No. | Percentage of Ammonium Ions to Total Cations contained in Bleach (mol %) | Organic Acid Ferric Complex Salt | Yellow Fog Density in Unexposed Portion |
|---|---|---|---|
| 6-1 | 100 | (A-I-1)-Fe | 0.03 |
| 6-2 | 60 | (A-I-1)-Fe | 0.03 |
| 6-3 | 50 | (A-I-1)-Fe | 0.02 |
| 6-4 | 30 | (A-I-1)-Fe | 0.01 |
| 6-5 | 10 | (A-I-1)-Fe | 0.01 |
| 6-6 | 0 | (A-I-1)-Fe | 0.01 |
| 6-7 | 100 | (A-I-2)-Fe | 0.03 |
| 6-8 | 60 | (A-I-2)-Fe | 0.03 |
| 6-9 | 50 | (A-I-2)-Fe | 0.02 |
| 6-10 | 30 | (A-I-2)-Fe | 0.01 |
| 6-11 | 10 | (A-I-2)-Fe | 0.01 |
| 6-12 | 0 | (A-I-2)-Fe | 0.01 |

As is shown in the table, there were little differences in amounts of residual silver and in formation of sulfides in the bleach. It was also found that the effect of the invention could be better brought out when the ratio of ammonium ions to the total cations contained in the bleach was not more than 50 mol %.

EXAMPLE 7

Experiments were carried out in the same manner as in Experiment No. 2-6 of Example 2, except that hardeners (H-1) and (H-2) used in Example 2 were replaced by the hardeners shown in Table 6.

The results are summarized in Table 6.

TABLE 6

| Experiment No. | Hardener | Yellow Fog Density in Unexposed Portion |
|---|---|---|
| 7-1 | Exemplified (VS-2) | 0.02 |
| 7-2 | Exemplified (VS-4) | 0.01 |
| 7-3 | Exemplified (VS-6) | 0.02 |
| 7-4 | Exemplified (VS-9) | 0.02 |
| 7-5 | Exemplified (VS-10) | 0.02 |
| 7-6 | Exemplified (VS-12) | 0.03 |
| 7-7 | Exemplified (VS-22) | 0.02 |
| 7-8 | Exemplified (VS-33) | 0.02 |
| 7-9 | Exemplified (VS-54) | 0.01 |
| 7-10 | Following RH-1 | 0.06 |
| 7-11 | Following RH-2 | 0.07 |
| 7-12 | Following RH-3 | 0.06 |
| 7-13 | Following RH-4 | 0.05 |
| 7-14 | Following RH-5 | 0.08 |

The chemical structures of hardeners RH-1, RH-2, RH-3, RH-4 and RH-5 shown in Table 6 are as follows:

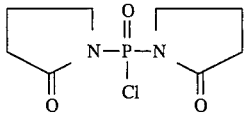

(RH-1)

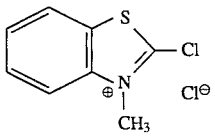

(RH-2)

-continued

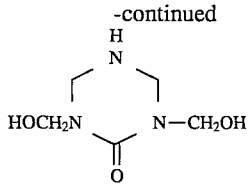

(RH-3)

$[NaO_3SO(CH_2)_2O_2S-H_2C]_4C$ (RH-4)

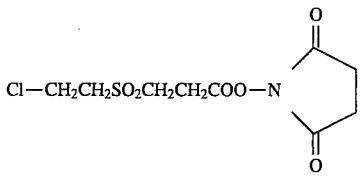

(RH-5)

As is apparent from Table 6, there is no significant difference in amounts of residual silver and in formation of sulfides. Further, the effect of the invention is better brought out when the vinylsulfone-type hardener is used in the processing according to the invention.

EXAMPLE 8

Experiments were conducted in the same way as in Experiment No. 2–7 of Example 2, except that one of the compounds shown in Table 7 was contained in the color negative film used in Experiment No. 2-7 in an amount of 10 mg/m2.

The results obtained are shown in Table 7.

TABLE 7

| Experiment No. | Additive (10 mg/m$^2$) | Yellow Fog Density of Unexposed Portion | Formation of Sulfides in Fixer |
|---|---|---|---|
| 8-1 | Not added | 0.07 | C |
| 8-2 | Phenol | 0.06 | B |
| 8-3 | Dehydroacetic acid | 0.06 | B |
| 8-4 | Thiazolyl benzimidazole | 0.07 | B |
| 8-5 | Chlorodiphenyl | 0.07 | B |
| 8-6 | Cresol | 0.06 | B |
| 8-7 | p-Amino-benzenesulfamide | 0.05 | B |
| 8-8 | (B-1-1) | 0.03 | A |
| 8-9 | (B-1-16) | 0.03 | A |
| 8-10 | (B-1-18) | 0.03 | A |
| 8-11 | (B-2-1) | 0.02 | A |
| 8-12 | (B-2-2) | 0.03 | A |
| 8-13 | (B-2-7) | 0.02 | A |
| 8-14 | (B-2-10) | 0.02 | A |
| 8-15 | (B-3-1) | 0.02 | A |
| 8-16 | (B-3-6) | 0.02 | A |

It can be understood from Table 7 that the effect of the invention can be better brought out by incorporating the compound represented by the foregoing formula [B-1], [B-2] or [B-3] in the light-sensitive material to be processed by the method of the invention.

EXAMPLE 9

Preparation of Silver Halide Color Photographic Light-sensitive Material (Color Paper)

A multilayered color photographic light-sensitive material was prepared by forming the following component layers on the titanium-oxide-bearing side of a paper support laminated with titanium-oxide-containing polyethylene on one side and with polyethylene on the other side. The coating solutions were prepared as follows:

Coating solution for 1st layer

A mixture of 27.3 g of yellow coupler (Y-1), 10 g of dye image stabilizer (ST-1), 6.67 g of dye image stabilizer (ST-2), 0.67 g of additive (HQ-1) and 6.67 g of high boiling solvent (DNP) was dissolved in 60 ml of ethyl acetate. The solution was dispersed, with a supersonic homogenizer, in 220 ml of 10% aqueous solution of gelatin containing 7 ml of 20% aqueous solution of surfactant (SU-1) to obtain a yellow coupler dispersion. Then, the dispersion was mixed with a blue-sensitive silver halide emulsion (containing 8.3 g of silver) prepared under conditions described later, so that a coating solution for the 1st layer was prepared.

Coating solutions for the 2nd to 7th layers were prepared likewise. Further, hardener (H-1) was added to the 2nd and 4th layers, and hardener (H-2) to the 7th layer. As coating aids, surfactants (SU-2) and (SU-3) were added to adjust the surface tension.

TABLE 8

| Layer | Component | Amount (g/m$^2$) |
|---|---|---|
| 7th layer (protective layer) | gelatin | 1.0 |
| 6th layer (UV absorbing layer) | gelatin | 0.35 |
| | UV absorbent (UV-1) | 0.10 |
| | UV absorbent (UV-2) | 0.04 |
| | UV absorbent (UV-3) | 0.18 |
| | antistain agent (HQ-1) | 0.01 |
| | DNP | 0.18 |
| | PVP | 0.03 |
| | anti-irradiation dye (AI-2) | 0.02 |
| 5th layer (red-sensitive layer) | gelatin | 1.21 |
| | red-sensitive silver chlorobromide emulsion (Em-C), in terms of Ag | 0.19 |
| | cyan coupler (C-1) | 0.20 |
| | cyan coupler (C-2) | 0.25 |
| | dye image stabilizer (ST-1) | 0.20 |
| | antistain agent (HQ-1) | 0.01 |
| | HBS-1 | 0.20 |
| | DOP | 0.20 |
| 4th layer (UV absorbing layer) | gelatin | 0.90 |
| | UV absorbent (UV-1) | 0.28 |
| | UV absorbent (UV-2) | 0.08 |
| | UV absorbent (UV-3) | 0.38 |
| | antistain agent (HQ-1) | 0.03 |
| | DNP | 0.35 |

TABLE 9

| Layer | Component | Amount (g/m$^2$) |
|---|---|---|
| 3rd layer (green-sensitive layer) | gelatin | 1.40 |
| | green-sensitive silver chlorobromide emulsion (Em-B), in terms of Ag | 0.15 |
| | magenta coupler (M-C) | 0.32 |
| | dye image stabilizer (ST-3) | 0.15 |
| | dye image stabilizer (ST-4) | 0.15 |
| | dye image stabilizer (ST-5) | 0.15 |
| | DNP | 0.20 |
| | anti-irradiation dye (AI-1) | 0.02 |
| 2nd layer (intermediate layer) | gelatin | 1.20 |
| | antistain agent (HQ-2) | 0.12 |
| | DIDP | 0.15 |
| 1st layer | gelatin | 1.20 |

TABLE 9-continued

| Layer | Component | Amount (g/m$^2$) |
|---|---|---|
| (blue-sensitive layer) | blue-sensitive silver chlorobromide emulsion (Em-A), in terms of Ag | 0.25 |
| | yellow coupler (Y-1) | 0.82 |
| | dye image stabilizer (ST-1) | 0.30 |
| | dye image stabilizer (ST-2) | 0.20 |
| | antistain agent (HQ-1) | 0.02 |
| | anti-irradiation dye (AI-3) | 0.02 |
| | DNP | 0.20 |
| Support | polyethylene laminated paper | |

This sample was exposed by the usual method and then processed by use of the following processes and processing solutions.

| Process | Processing Temp. | Processing Time | Replenishing Rate |
|---|---|---|---|
| (1) Color developing | 35.0 ± 0.3° C. | 45 sec | 162 ml/m$^2$ |
| (2) Bleach-fixing | 35.0 ± 0.5° C. | 45 sec | see Tables 10 to 12 |
| (3) Stabilizing (three-tank cascade) | 30 to 34° C. | 90 sec | 248 ml/m$^2$ |
| (4) Drying | 60 to 80° C. | 30 sec | — |

Color Developer

| | |
|---|---|
| Triethanolamine | 10 g |
| Ethylene glycol | 6 g |
| N,N-Diethylhydroxylamine | 3.6 g |
| Hydrazinodiacetic acid | 5.0 g |
| Potassium bromide | 20 mg |
| Potassium chloride | 2.5 g |
| Diethylenetriaminepentaacetic acid | 5 g |
| Potassium sulfite | $5.0 \times 10^{-4}$ mol |
| Color developing agent (3-methyl-4-amino-N-ethyl-N-(β-methanesulfonamidoethyl)-aniline sulfate) | 5.5 g |
| Potassium carbonate | 25 g |
| Potassium hydrogencarbonate | 5 g |

Water was added to make 1000 ml, and the pH was adjusted to 10.10 with potassium hydroxide or sulfuric acid.

Color Developing Replenisher

| | |
|---|---|
| Triethanolamine | 14.0 g |
| Ethylene glycol | 8.0 g |
| N,N-Diethylhydroxylamine | 5 g |
| Hydrazinodiacetic acid | 7.5 g |
| Potassium bromide | 8 mg |
| Potassium chloride | 0.3 g |
| Diethylenetriaminepentaacetic acid | 7.5 g |
| Potassium sulfite | $7.0 \times 10^{-4}$ mol |
| Color developing agent (3-methyl-4-amino-N-ethyl-N-(β-methanesulfonamidoethyl)-aniline sulfate) | 8 g |
| Potassium carbonate | 30 g |
| Potassium hydrogencarbonate | 1 g |

Water was added to make 1000 ml, and the pH was adjusted to 10.40 with potassium hydroxide or sulfuric acid.

Bleach-fixer

| | |
|---|---|
| Water | 600 ml |
| Organic acid ferric complex salt (described in Tables 10 to 12) | 0.15 mol |
| Thiosulfate | 0.6 mol |
| Sulfite | 0.15 mol |
| 1,3-propanediaminetetraacetic acid | 2 g |

The pH was adjusted to 7.0 with aqueous ammonia, potassium hydroxide or acetic acid, and water was added to make 1000 ml.

Bleach-fixing Replenisher

The concentration of each component was raised to the value shown in Tables 10 to 12, and the pH was adjusted to 5.0.

Stabilizer and Stabilizing Replenisher

| | |
|---|---|
| Ortho-phenylphenol | 0.1 g |
| MST (product of Ciba-Geigy AG) | 1.0 g |
| $ZnSO_4.7H_2O$ | 0.1 g |
| Ammonium sulfite (40% solution) | 5.0 ml |
| 1-Hydroxyethylidene-1,1-diphosphonic acid (60% solution) | 3.0 g |
| Ethylenediaminetetraacetic acid | 1.5 g |

The pH was adjusted to 7.8 with aqueous ammonia or sulfuric acid and water was added to make 1000 ml.

A continuous processing was run by use of the color paper and processing solutions prepared as above.

In running the continuous processing, tanks of an automatic processor were filled with the above color developing tank solution, bleach-fixing tank solution and stabilizing tank solution. And, while carrying on processing of the color paper, the above color developing replenisher (replenishing rate: 80 ml/m$^2$), bleach-fixing replenisher (replenishing rate: shown in Tables 10 to 12) and stabilizing replenisher (replenishing rate: 250 ml/m$^2$) were replenished through metering pumps at intervals of 3 minutes.

This continuous processing was carried on, at a daily processing amount of 0.05 R, till the volume of bleach-fixer replenished to the bleach-fixer tank reached 3 times the capacity of the bleach-fixer tank. Here, 1 R means that the bleach-fixer is replenished up to a volume equal to the capacity of the bleach-fixing tank.

The exposed portion of the processed sample was divided into two parts. One was subjected to X-ray fluorescence analysis for determining the amount of residual silver. The other was used for measuring R density and then rebleached in an aqueous solution of ethylenediaminetetracetic acid ferric complex salt (100 g/l, pH 6.5). R density after the rebleaching was measured to determine the recoloring property (measured value before rebleaching—measured value after rebleaching). The processed color paper was also checked for stains on the edge portion. Further, formation of sulfides was visually examined on the bleach-fixing tank solution and bleach-fixing replenisher after completion of the processing. The results are shown in Tables 10 to 12.

In Tables 10 to 12, the letters in the column of sulfide formation have the following meanings:

A: no sulfides are observed at all.

B: very slight floating matters are observed on the liquid surface.

C: faint formation of sulfides are observed.
D: obvious formation of sulfides are observed.
E: heavy formation of sulfides are observed, and the tank wall is tinged yellow.

The letters in the column of edge stain have the following meanings:

A: no edge stains are observed at all.
B: very slight edge stains are observed.
C: slight edge stains are observed.
D: obvious edge stains are observed.
E: heavy edge stains are observed.

In Table 10, EDTA-Fe is an ethylenediaminetetraacetic acid ferric complex salt; PDTA-Fe, 1,3-propylenediaminetetraacetic acid ferric complex salt; DTPA-Fe, diethylenetriaminepentaacetic acid ferric complex salt.

TABLE 10

| Experiment No. | Organic Acid Ferric Complex Salt | Bleach-fixer Replenisning Rate (ml/m$^2$) | Bleach-fixing Replenisher Concentration | Amount of Residual Silver (mg/100 cm$^2$) | Recoloring Property | Edge Effect | Formation of Sulfides Tank Solution | Formation of Sulfides Repleni-sher |
|---|---|---|---|---|---|---|---|---|
| 9-1 (Comparison) | EDTA-Fe | 400 | Tank solution × 1.1 | 0.0 | 0.0 | A | A | B |
| 9-2 (Comparison) | EDTA-Fe | 200 | Tank solution × 1.2 | 0.2 | 0.0 | A | B | B |
| 9-3 (Comparison) | EDTA-Fe | 100 | Tank solution × 1.4 | 0.8 | −0.12 | B | D | D |
| 9-4 (Comparison) | EDTA-Fe | 50 | Tank solution × 1.8 | 1.2 | −0.18 | C | D | D |
| 9-5 (Comparison) | EDTA-Fe | 25 | Tank solution × 2.6 | 1.4 | −0.22 | C | E | E |
| 9-6 (Comparison) | EDTA-Fe | 15 | Tank solution × 3.0 | 1.7 | −0.25 | C | E | E |
| 9-7 (Comparison) | PDTA-Fe | 400 | Tank solution × 1.1 | 1.2 | −0.10 | B | D | E |
| 9-8 (Comparison) | PDTA-Fe | 200 | Tank solution × 1.2 | 1.4 | −0.15 | B | E | E |
| 9-9 (Comparison) | PDTA-Fe | 100 | Tank solution × 1.4 | 1.8 | −0.20 | C | E | E |
| 9-10 (Comparison) | PDTA-Fe | 50 | Tank solution × 1.8 | 2.1 | −0.21 | C | E | E |
| 9-11 (Comparison) | PDTA-Fe | 25 | Tank solution × 2.6 | 2.2 | −0.21 | C | E | E |
| 9-12 (Comparison) | PDTA-Fe | 15 | Tank solution × 3.0 | 2.2 | −0.24 | C | E | E |
| 9-13 (Comparison) | DTPA-Fe | 400 | Tank solution × 1.1 | 0.0 | 0.0 | C | A | A |
| 9-14 (Comparison) | DTPA-Fe | 200 | Tank solution × 1.2 | 0.3 | −0.03 | D | A | A |
| 9-15 (Comparison) | DTPA-Fe | 100 | Tank solution × 1.4 | 0.9 | −0.17 | E | A | B |
| 9-16 (Comparison) | DTPA-Fe | 50 | Tank solution × 1.8 | 1.4 | −0.23 | E | B | B |
| 9-17 (Comparison) | DTPA-Fe | 25 | Tank solution × 2.6 | 1.6 | −0.27 | E | B | B |
| 9-18 (Comparison) | DTPA-Fe | 15 | Tank solution × 3.0 | 1.9 | −0.28 | E | B | C |
| 9-19 (Comparison) | A-II-1 | 400 | Tank solution × 1.1 | 0.0 | 0.0 | A | A | A |
| 9-20 (Comparison) | A-II-1 | 200 | Tank solution × 1.2 | 0.0 | 0.0 | A | A | A |

TABLE 11

| Experiment No. | Organic Acid Ferric Complex Salt | Bleach-fixer Replenisning Rate (ml/m$^2$) | Bleach-fixing Replenisher Concentration | Amount of Residual Silver (mg/100 cm$^2$) | Recoloring Property | Edge Effect | Formation of Sulfides Tank Solution | Formation of Sulfides Repleni-sher |
|---|---|---|---|---|---|---|---|---|
| 9-21 (Invention) | A-II-1 | 100 | Tank solution × 1.4 | 0.0 | 0.0 | A | A | A |
| 9-22 (Invention) | A-II-1 | 50 | Tank solution × 1.8 | 0.0 | 0.0 | A | A | A |
| 9-23 (Invention) | A-II-1 | 25 | Tank solution × 2.6 | 0.0 | 0.0 | A | A | B |
| 9-24 (Invention) | A-II-1 | 15 | Tank solution × 3.0 | 0.2 | −0.05 | B | B | B |
| 9-25 (Comparison) | A-II-3 | 400 | Tank solution × 1.1 | 0.0 | 0.0 | A | A | A |
| 9-26 (Comparison) | A-II-3 | 200 | Tank solution × 1.2 | 0.0 | 0.0 | A | A | A |

TABLE 11-continued

| Experiment No. | Organic Acid Ferric Complex Salt | Bleach-fixer Replenisning Rate (ml/m$^2$) | Bleach-fixing Replenisher Concentration | Amount of Residual Silver (mg/100 cm$^2$) | Recoloring Property | Edge Effect | Formation of Sulfides Tank Solution | Formation of Sulfides Repleni-sher |
|---|---|---|---|---|---|---|---|---|
| 9-27 (Invention) | A-II-3 | 100 | Tank solution × 1.4 | 0.0 | 0.0 | A | A | A |
| 9-28 (Invention) | A-II-3 | 50 | Tank solution × 1.8 | 0.0 | 0.0 | A | A | A |
| 9-29 (Invention) | A-II-3 | 25 | Tank solution × 2.6 | 0.0 | 0.0 | A | A | B |
| 9-30 (Invention) | A-II-3 | 15 | Tank solution × 3.0 | 0.3 | −0.08 | B | B | B |
| 9-31 (Comparison) | A-II-15 | 400 | Tank solution × 1.1 | 0.0 | 0.0 | A | A | A |
| 9-32 (Comparison) | A-II-15 | 200 | Tank solution × 1.2 | 0.0 | 0.0 | A | A | A |
| 9-33 (Invention) | A-II-15 | 100 | Tank solution × 1.4 | 0.0 | 0.0 | A | A | A |
| 9-34 (Invention) | A-II-15 | 50 | Tank solution × 1.8 | 0.0 | 0.0 | A | A | A |
| 9-35 (Invention) | A-II-15 | 25 | Tank solution × 2.6 | 0.0 | −0.03 | A | A | B |
| 9-36 (Invention) | A-II-15 | 15 | Tank solution × 3.0 | 0.4 | −0.10 | B | B | B |
| 9-37 (Comparison) | A-III-1 | 400 | Tank solution × 1.1 | 0.0 | 0.0 | A | A | A |
| 9-38 (Comparison) | A-III-1 | 200 | Tank solution × 1.2 | 0.0 | 0.0 | A | A | A |
| 9-39 (Invention) | A-III-1 | 100 | Tank solution × 1.4 | 0.0 | 0.0 | A | A | B |
| 9-40 (Invention) | A-III-1 | 50 | Tank solution × 1.8 | 0.1 | −0.03 | A | B | B |

TABLE 12

| Experiment No. | Organic Acid Ferric Complex Salt | Bleach-fixer Replenisning Rate (ml/m$^2$) | Bleach-fixing Replenisher Concentration | Amount of Residual Silver (mg/100 cm$^2$) | Recoloring Property | Edge Effect | Formation of Sulfides Tank Solution | Formation of Sulfides Repleni-sher |
|---|---|---|---|---|---|---|---|---|
| 9-41 (Invention) | A-III-1 | 25 | Tank solution × 2.6 | 0.3 | −0.08 | A | B | B |
| 9-42 (Invention) | A-III-1 | 15 | Tank solution × 3.0 | 0.5 | −0.15 | B | B | C |
| 9-43 (Comparison) | A-III-2 | 400 | Tank solution × 1.1 | 0.0 | 0.0 | A | A | A |
| 9-44 (Comparison) | A-III-2 | 200 | Tank solution × 1.2 | 0.0 | 0.0 | A | A | A |
| 9-45 (Invention) | A-III-2 | 100 | Tank solution × 1.4 | 0.0 | 0.0 | A | A | B |
| 9-46 (Invention) | A-III-2 | 50 | Tank solution × 1.8 | 0.2 | −0.05 | A | B | B |
| 9-47 (Invention) | A-III-2 | 25 | Tank solution × 2.6 | 0.6 | −0.10 | A | B | B |
| 9-48 (Invention) | A-III-2 | 15 | Tank solution × 3.0 | 0.7 | −0.17 | B | B | C |
| 9-49 (Comparison) | A-III-6 | 400 | Tank solution × 1.1 | 0.0 | 0.0 | A | A | A |
| 9-50 (Comparison) | A-III-6 | 200 | Tank solution × 1.2 | 0.0 | 0.0 | A | A | A |
| 9-51 (Invention) | A-III-6 | 100 | Tank solution × 1.4 | 0.0 | 0.0 | A | A | B |
| 9-52 (Invention) | A-III-6 | 50 | Tank solution × 1.8 | 0.2 | −0.05 | A | B | B |
| 9-53 (Invention) | A-III-6 | 25 | Tank solution × 2.6 | 0.4 | −0.12 | A | B | B |
| 9-54 (Invention) | A-III-6 | 15 | Tank solution × 3.0 | 0.6 | −0.17 | B | B | C |
| 9-55 (comparison) | A-III-21 | 400 | Tank solution × 1.1 | 0.0 | 0.0 | A | A | A |
| 9-56 (comparison) | A-III-21 | 200 | Tank solution × 1.2 | 0.0 | 0.0 | A | A | A |
| 9-57 (Invention) | A-III-21 | 100 | Tank solution × 1.4 | 0.0 | 0.0 | A | A | B |

TABLE 12-continued

| Experiment No. | Organic Acid Ferric Complex Salt | Bleach-fixer Replenisning Rate (ml/m²) | Bleach-fixing Replenisher Concentration | Amount of Residual Silver (mg/100 cm²) | Recoloring Property | Edge Effect | Formation of Sulfides Tank Solution | Formation of Sulfides Replenisher |
|---|---|---|---|---|---|---|---|---|
| 9-58 (Invention) | A-III-21 | 50 | Tank Solution solution × 1.8 | 0.2 | −0.06 | A | B | B |
| 9-59 (Invention) | A-III-21 | 25 | Tank solution × 2.6 | 0.6 | −0.14 | A | B | B |
| 9-60 (Invention) | A-III-21 | 15 | Tank solution × 3.0 | 0.8 | −0.15 | B | B | C |

As is apparent from Tables 10 to 12, use of the organic acid ferric complex salt of the invention lessens the amount of residual silver, minimizes edge stains and raises the preservability of a bleach-fixer, even when the replenishing rate of bleach-fixer is reduced.

The bleach and bleach-fixer according to this inventive method for processing silver halide color photographic light-sensitive materials is high in biodegradability, less in amount of waste liquids, and thereby excellent in environmental compatibility. Further, this inventive processing method provides high-quality images less in edge staining and free from bleach fogging, besides its capability of providing a processing solution with stable processing activities.

What is claimed is:

1. A method of processing exposed silver halide color photographic light-sensitive material comprising steps of color developing, bleaching with a bleaching solution, fixing and stabilizing the silver halide color photographic light-sensitive material, or color developing, bleach-fixing with a bleach-fixing solution and stabilizing the silver halide color photographic light-sensitive material, wherein (i) the bleaching step includes replenishing the bleaching solution with a bleach replenisher prepared by regenerating an overflow liquid from the bleaching solution, by adding a regenerant, or (ii) the bleach-fixing step includes replenishing the bleach-fixing solution with a bleach-fixing replenisher prepared by regenerating an overflow liquid from the bleach-fixing solution, by adding said regenerant:

wherein the regenerant is a ferric complex salt of a compound represented by Formula A-II or A-III;

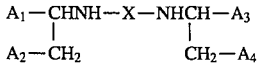

Formula A-II wherein $A_1$, $A_2$, $A_3$ and $A_4$ each represents a $—CH_2OH$, $—PO_3(M)_2$ or —COOM group and may be the same or different; M represents a hydrogen atom or alkali metal atom or an ammonium or organic ammonium group; X represents an alkylene group having 2 to 6 carbon atoms or a $—(B_1O)_n—B_2—$ group, where n represents an integer of 1 to 8, $B_1$ and $B_2$, which may be the same or different, each represents an alkylene group having 1 to 5 carbon atoms;

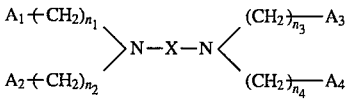

Formula A-III wherein $A_1$, $A_2$, $A_3$ and $A_4$ each represents a $—CH_2OH$, $—PO_3(M_2)_2$ or $—COOM_1$ group and may be the same or different, where $M_1$ and $M_2$ each represents a hydrogen atom or alkali metal atom or an ammonium or organic ammonium group; X represents a straight-chain or branched alkylene group having 2 to 6 carbon atoms, a saturated or unsaturated ring-forming organic group or a $—(B_1O)_n—B_2—$ group, where n is an integer of 1 to 8, $B_1$ and $B_2$, which may be the same or different, each represents an alkylene group, having 1 to 5 carbon atoms; $n_1$, $n_2$, $n_3$ and $n_4$ each represents an integer of 1 or more and may be the same or different, provided that at least one of them is 2 or more.

2. The method of claim 1, wherein the amount of ammonium ion content in the bleaching solution or bleach-fixing solution is not more than 50 mol % of the total cation content.

3. The method of claim 1, wherein the bleaching solution or the bleach-fixing solution contains 0.1 to 2.0 mol per liter of a bleaching agent.

4. The method of claim 3, wherein the content of the bleaching agent is 0.15 to 1.5 mol per liter.

5. The method of claim 1, wherein the bleaching solution or bleach-fixing solution is replenished with not more than 1000 ml per $m^2$ of the silver halide photographic light-sensitive material being processed.

6. The method of claim 5, wherein the replenishing amount is 20 ml to 600 ml.

7. The method of claim 6, wherein the replenishing amount is 40 ml to 500 ml.

8. The method of claim 1, wherein the ferric salt is a ferric complex salt of the compound of Formula A-II.

9. The method of claim 8, wherein the bleaching solution or the bleach-fixing solution contains a bleaching agent which is a ferric complex salt of a compound represented by Formula A-II.

10. The method of claim 1, wherein the ferric complex salt is a ferric complex salt of the compound of Formula A-III.

11. The method of claim 10, wherein the bleaching solution or the bleach-fixing solution contains a bleaching agent which is a ferric complex salt of a compound represented by Formula A-III.

12. The method of claim 1, wherein an amount of the regenerant being added to the overflow bleaching or bleach-fixing solution is 0.1 g to 50 g per 1000 ml of the overflow bleaching or bleach-fixing solution.

13. The method of claim 12, wherein the amount of the regenerant being added to the overflow bleaching or bleach fixing solution is 1 g to 50 g per 1000 ml of the overflow bleaching or bleach-fixing solution.

14. A method of processing exposed silver halide color photographic light-sensitive material comprising steps of developing, either bleaching with a bleaching solution and fixing or bleaching-fixing with a bleach-fixing solution, and stabilizing, in which the bleaching solution or bleach-fixing solution, having been used for bleaching is regenerated by adding a regenerant and the regenerated bleaching solution is re-used, wherein the bleaching solution or bleach-fixing solution comprises a bleaching agent which is a ferric complex salt of a compound selected from the group consisting of

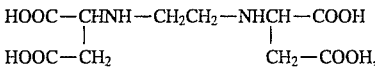

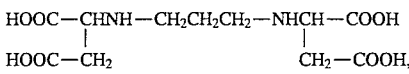

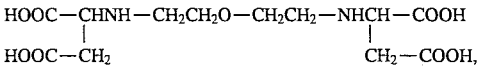

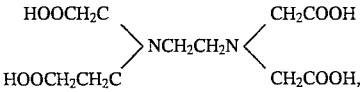

-continued

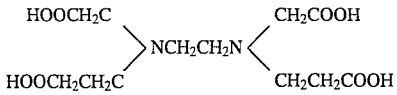

and

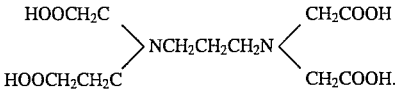

15. The method of claim 14, wherein the content of the bleaching agent is 0.15 to 1.5 mol per liter of the bleaching or bleach-fixing solution and the amount of the bleaching or bleach-fixing solution being replenished is 40 ml to 500 ml per $m^2$ of the silver halide photographic light-sensitive material.

* * * * *